US007444770B2

(12) United States Patent
Wellington, Jr.

(10) Patent No.: US 7,444,770 B2
(45) Date of Patent: Nov. 4, 2008

(54) DESIGNS ON A SPHERE THAT EXHIBIT SPIN INDUCED CONTRAST

(76) Inventor: James L. Wellington, Jr., 116 W. Washington St., Goshen, IN (US) 48526

( * ) Notice: Subject to any disclaimer, the term of this patent is extended or adjusted under 35 U.S.C. 154(b) by 61 days.

(21) Appl. No.: 11/539,740

(22) Filed: Oct. 9, 2006

(65) Prior Publication Data

US 2007/0084095 A1 Apr. 19, 2007

Related U.S. Application Data

(60) Provisional application No. 60/724,979, filed on Oct. 7, 2005.

(51) Int. Cl.
*G09F 3/00* (2006.01)

(52) U.S. Cl. ..... 40/327

(58) Field of Classification Search ..... 40/327; 473/599, 604; D21/707, 709, 713, 714
See application file for complete search history.

(56) References Cited

U.S. PATENT DOCUMENTS

| | | | | |
|---|---|---|---|---|
| D27,441 | S | | 7/1897 | Dunn |
| 676,506 | A | | 6/1901 | Knight et al. |
| D55,413 | S | | 6/1920 | Cigol |
| 2,504,650 | A | | 4/1950 | Chessrown |
| 2,709,595 | A | | 5/1955 | DeVries |
| 2,925,273 | A | | 2/1960 | Pratt |
| 3,630,601 | A | | 12/1971 | Lehovec |
| 4,170,352 | A | | 10/1979 | Vcala |
| 4,546,975 | A | | 10/1985 | Nims |
| 4,796,888 | A | | 1/1989 | Louez |
| 5,067,719 | A | | 11/1991 | Mook |
| D357,958 | S | * | 5/1995 | Audero, Jr. ..... D21/713 |
| D359,093 | S | * | 6/1995 | Shishido et al. ..... D21/713 |
| 5,544,889 | A | | 8/1996 | Moon |
| 5,562,552 | A | * | 10/1996 | Thurman ..... 473/379 |

(Continued)

FOREIGN PATENT DOCUMENTS

WO WO 2004/039457 5/2004

OTHER PUBLICATIONS

Footmart, http://worldfootbag.com/catalog2; Jul. 9, 2007, p. 1.

(Continued)

*Primary Examiner*—Joanne Silbermann
*Assistant Examiner*—Christopher E Veraa
(74) *Attorney, Agent, or Firm*—Woodard, Emhardt, Moriarty, McNett & Henry LLP

(57) ABSTRACT

A methodology is disclosed for arranging markings on a ball or sphere where the markings exhibit spin induced contrast when the ball or sphere is rotated at a sufficient speed. The methodology is based on a layout utilizing a plurality of geodesic lines symmetrically arranged around the ball or sphere. Various markings can then be applied on the basis of the layout such that when the ball or sphere is rotated, the markings form contrast lines that are perpendicular to the axis of spin of the ball or sphere, at any axis of spin. These contrast line allow an observer to more accurately detect the axis of spin of the ball or sphere as well as track the ball or sphere in motion.

35 Claims, 17 Drawing Sheets

U.S. PATENT DOCUMENTS

| | | | | |
|---|---|---|---|---|
| 5,711,725 | A | 1/1998 | Bengtson | |
| 5,820,501 | A * | 10/1998 | Soofi | 473/599 |
| D429,510 | S | 8/2000 | Sullivan | |
| 6,529,184 | B1 * | 3/2003 | Julienne | 345/157 |
| 6,722,889 | B1 | 4/2004 | Page et al. | |
| 7,037,224 | B1 | 5/2006 | Page et al. | |
| 7,303,492 | B2 * | 12/2007 | Aoyama et al. | 473/383 |
| 2006/0199684 | A1 * | 9/2006 | Kelly | 473/599 |
| 2007/0093323 | A1 * | 4/2007 | Walton | 473/569 |

OTHER PUBLICATIONS

Brown, S. Kenneth, What is A Building?, Notices of the AMS, vol. 49, No. 10, Nov. 2002, pp. 1244-1245.

Puma, http://www.misl.net/upload_images/SanaldoAction; Nov. 15, 2006, p. 1.

H.S.M. Coxeter, F.R.S.; Introduction to Geometry 2nd Edition; 1969; Chapter 4 pp. 50-66; Chapter 15 pp. 263-286; John Wiley & SOns, Inc.; U.S.

Rose-Hulman website; www.rose-hulman.edu/brought/epubs/soccer/soccerpics.html; Higher Genus "Soccer Balls" Picture Page; Aug. 4, 2006.

Spering, Miriam et al., Effects of contrast on smooth pursuit eye movement; Journal of Vision (2005)5, 455-465; Giessen, Germany.

Soccer Ballworld, Official World Cup Match Balls, Feb. 1, 2007, pp. 1-3, WWW.SOCCERBALLWORLD.COM/HISTORY/WCBALLS.HTML.

Adler's Physiology of the Eye (Paul L. Kaufman ed. 10th ed., 2003) (1950), pp. 463, 469, 474,479, 480, 482, 500, 507-509, 511-511, 520, 522, 524, 527, 530 and 581.

* cited by examiner

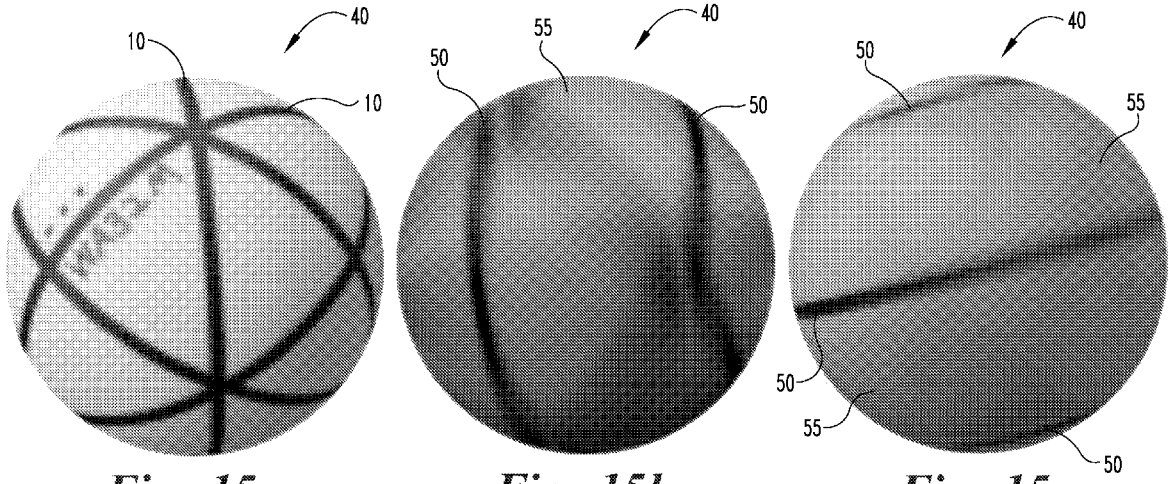
*Fig. 15a* *Fig. 15b* *Fig. 15c*

DESIGNS ON A SPHERE THAT EXHIBIT SPIN INDUCED CONTRAST

CROSS-REFERENCE TO RELATED APPLICATIONS

The present application claims the benefit of U.S. Provisional Application Ser. No. 60/724,979 filed on Oct. 7, 2005, which is hereby incorporated by reference in its entirety.

BACKGROUND

The present disclosure relates to the field of balls. In particular, this disclosure concerns a design on a ball that exhibits spin induced contrast.

Vision science research has shown that the human visual system differentiates objects from their surroundings by detecting differences in luminance, color, texture, motion and depth.

Moving and spinning balls are a central part of many sports and other recreational activities. In most circumstances it is important for athletes and/or spectators to follow the ball as it moves. This may be particularly important when a sports event is televised and the ball is relatively small and/or moves at high speed. Similarly, it is helpful for athletes to accurately determine what spin is on the ball to accurately anticipate the ball's trajectory and interactions with other objects.

Furthermore, some individuals, particularly professional athletes, are particularly adept at following a ball deep into the "zone" where they make contact with the ball. In effect, they follow the ball particularly well. Efficiently following the ball can provide significant performance advantages to an athlete in terms of successfully hitting or catching the ball.

One way to improve an individual's ability to follow a moving object, such as a ball, is for the moving object to visually contrast with its surroundings. For example, tennis balls are colored a high visibility yellow which contrasts with the court and environments typically found around tennis courts. As another example, a ball can include multiple colors that contrast with each other. In that way, the contrast found on the ball helps the individual to more easily follow the ball.

It is not unknown to add contrasting portions to a ball. For example, the classic soccer ball having black pentagons surrounded by white hexagons was originally developed to improve the visibility of the ball for black and white television viewers. As another example, the football used in American colleges and high schools include a white band that partially encircles either end of the football. In both examples, the markings add contrasting colors that improve visual tracking of the ball by both participants and spectators. However, there are additional benefits that can be achieved with ball markings that are not provided by these limited examples. For example, it is possible to mark a ball to improve visual recognition of ball spin. Furthermore, existing markings are not necessarily optimized for particular conditions such as ambient lighting and/or distance between the viewer and the ball.

Research in vision science indicates that contrast improves visibility, as has experimentation with prototypes. Below are several references taken from *Adler's Physiology of the Eye* that support contrast improving visibility.

O'Mullane and Knox have shown increased accuracy and speed of smooth pursuit tracking eye movements with increased target contrast. O'Mullane G, Knox P C: Modification of smooth pursuit initiation by target contrast, *Vision Res* 39:3459, 1999.

Collewijn and Erkelens have shown increased smooth vergence tracking with increased depth stimuli. Collewijn H, Erkelens C J: Binocular eye movements and the perception of depth. In Kowler E (ed): *Eye movements and their role in visual and cognitive processes,* New York, 1990, Elsevier.

Legge and Gu have shown increased depth perception with increased target contrast. Legge G E, Gu Y: Stereopsis and contrast, *Vision Res* 29:989, 1989. This can be explained by an increased stimulus strength which increases and/or recruits more signals from depth (disparity) selective neurons. Harwerth R S, Schor C M: Binocular Vision. In Kauffman P L, Alm A (ed): *Adler's physiology of the eye,* 2003, Mosby.

The "Bruche brightness enhancement effect" demonstrates that flickering lights appear brighter than a nonflickering standard. Brucke E: Uber die Nutzeffect intermitterender Netzhautreizungen. Sitzungsberichte der MathematischNaturwissenschaftlichen, Classe der Kaiserlichen Akademie der Wissenschaften 49:128, 1848.

Regan has shown that the human visual system differentiates objects from their surroundings by detecting differences in: luminance, color, texture, motion, and depth. Regan D: A brief review of some of the stimili and analysis methods used in spatiotemporal vision research. In Regan D.(ed): *Spatial vision, London,* 1991, MacMillan.

Hogervorst, Bradshaw, and Eagle have reported that the human visual system contains filters sensitive to the contrast of motion-defined form. Hogervorst M A, Bradshaw M F, Eagle R A: Spatial frequency tuning for 3D corrugations from motion parallax, *Vision Res* 40:2149, 2000.

Kwan and Regan have reported that the human visual system contains filters that are selective for the orientation of texture-defined form. Kwan L, Reagan D: Orientation-tuned spatial filters for texture-defined form, *Vision Res* 38:3849, 1998.

Stark, Vossius, and Young have found dramatically decreased reaction time in eye tracking movements for predictable target changes compared to unpredictable changes. Stark L, Vossius G, Young L R: Predictive control of eye tracking movements, *IRE Trans Hum Factors Electron* 3:52, 1962.

SUMMARY OF THE DISCLOSURE

One form of the present disclosure is a sphere marked so as to exhibit a spin induced contrast line when the sphere is rotated. Another form of the present disclosure is a play ball marked so as to exhibit a spin induced contrast line when the ball is rotated. Other forms include unique methods of marking a sphere or a ball with marking that exhibit a spin induced contrast line when rotated.

In one aspect of the disclosure, a ball with markings that exhibit spin induced contrast is disclosed comprising: a layout pattern that corresponds to the diameter of the ball, the layout pattern prepared from plurality of symmetrically arranged geodesics, wherein the number of geodesics is selected from the group consisting of 6, 9 and 15 and wherein the layout pattern has a plurality of vertices and a plurality of triangular elements; a ball color; and a plurality of markings located on the ball on the basis of the layout pattern, wherein the plurality of markings are colored a marking color which contrasts the ball color and the plurality of markings exhibit a spin induced contrast line when the ball is rotated about any axis of rotation and wherein the plurality of markings incorporate a majority of the geodesics.

In another aspect of the disclosure, a method of marking a ball with markings that exhibit a spin induced contrast line is disclosed comprising the steps of: a) selecting a Coxeter Complex pattern from the group consisting of A3, B3 and H3, which includes a plurality of geodesics and a plurality of geodesic vertices; b) plotting the selected Coxeter Complex pattern over the surface of the ball; c) selecting markings that incorporate a majority of the geodesics that will exhibit spin induced contrast; and d) applying to the surface of the ball the markings selected wherein the location of the markings is correlated with the selected Coxeter Complex pattern and wherein the markings contrasts the ball.

In yet another aspect of the disclosure, a ball with markings that exhibit spin induced contrast is disclosed comprising: a ball color, and plurality of triangular markings on the ball colored a marking color that contrasts the ball color, wherein the triangular markings are substantially uniformly scaled from triangular elements of a Coxeter Complex pattern corresponding to the diameter of the ball selected from the group consisting of A3, B3 and H3 and wherein the triangular markings are arranged on the ball to be substantially centered in the triangular elements of the selected Coxeter Complex pattern.

Further forms, embodiments, objects, advantages, benefits, features and aspects of the present disclosure will become apparent from the detailed description and drawings contained herein.

BRIEF DESCRIPTION OF THE DRAWINGS

FIG. 15*a* is a photograph of a table tennis ball including an embodiment of the A3 pattern of FIG. 2.

FIG. 15*b* is a photograph of the table tennis ball of FIG. 15*a* rotating about an axis of rotation.

FIG. 15*c* is a photograph of the table tennis ball of FIG. 15*a* rotating about a different axis of rotation.

DETAILED DESCRIPTION OF THE ILLUSTRATED EMBODIMENTS

Figure 1:
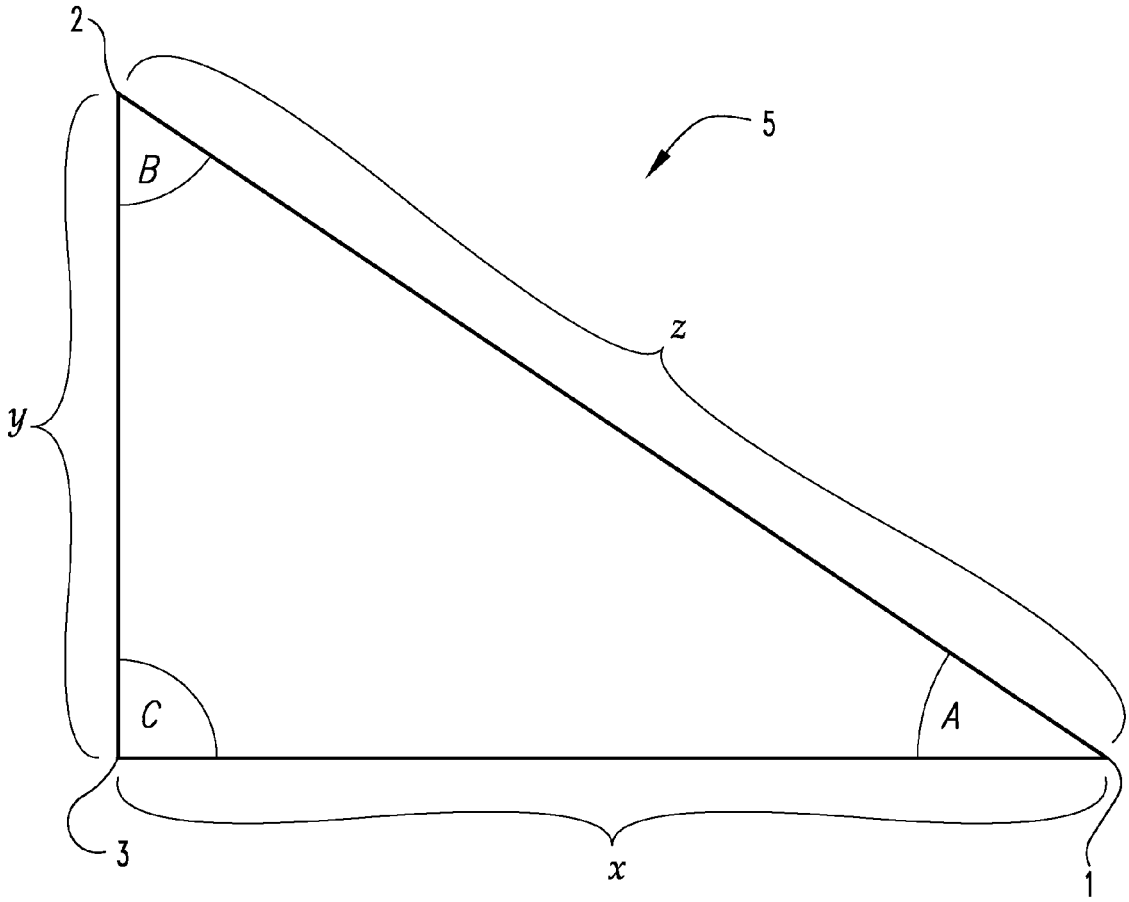
FIG. 1 is diagrammatic representation of a single Coxeter Complex panel as illustrated in FIGS. 2-4.

For the purpose of promoting an understanding of the principles of the disclosure, reference will now be made to certain embodiments thereof and specific language will be used to describe the same. It will nevertheless be understood that no limitation of the scope of the claims is thereby intended, such alterations, further modifications and further applications of the principles of the disclosure as described herein being contemplated as would normally occur to one skilled in the art to which the disclosure relates.

A methodology is provided for creating ordered patterns for application to a ball. The ordered pattern can be applied to the surface of the ball through known printing or marking means or, in the alternative or in addition, the ordered pattern can be incorporated into a paneling pattern utilized in the construction of the ball.

Once applied or incorporated into the ball, the ordered pattern increases the visual contrast of the ball, making the ball easier for the human eye to see and track. In several embodiments, the ordered pattern consists of designs placed on the surface of the ball in such a way that when the ball spins, contrast lines appear that are perpendicular to the axis of spin. Such contrast lines preferably increase the visual contrast of the spinning ball, making the ball easier to see and track as well as providing a sense of the axis of the spin of the ball to the viewer. Furthermore, the contrast line also may indicate the magnitude of the spin. Knowledge of the axis and magnitude of spin of the ball may allow a viewer to more readily anticipate the flight of the ball through the air and/or how the ball will interact with other objects.

This spin induced contrast line effect is created by locating the designs on the basis of several geodesic line patterns derived from the Coxeter Complex. The Coxeter Complex consists of the intersections of a sphere with the planes of symmetry of a Platonic solid (tetrahedron, cube, octahedron, icosahedron, dodecahedron) whose corners lie on that sphere. In this case each geodesic line corresponds with each plane of symmetry. Utilizing a pattern derived from the Coxeter Complex provides symmetric placement of geodesics lines on the surface of the ball. Three geodesic line patterns are utilized. The first line pattern, labeled A3, has tetrahedral symmetry and consists of 6 geodesics symmetrically placed about the ball. The second line pattern, labeled B3, has both cubic and octahedral symmetry and consists of 9 geodesics symmetrically placed about the ball. The third line pattern, labeled H3, has both icosahedral and dodecahedral symmetry and consists of 15 geodesics symmetrically placed about the ball.

The following paragraphs describe how to lay out a pattern of geodesic lines corresponding to A3, B3 and H3 using the following common designations. As follows, "#" represents a discrete number, such as 1, 2, 3, etc. used to distinguish various reference points in the pattern from other similar reference points. "G #" represents a particular geodesic line in the individual pattern. In this context, geodesic line refers to a great circle on a sphere. "P #" represents a pole location on the surface of the ball. It should be understood that in this context, "pole" indicates a location on the surface of the ball where two geodesic lines intersect at a normal, or 90 degree angle. "DM #" represents a distance marker location on the surface of the ball that corresponds to a point in which two or more geodesic lines intersect.

The following directions describing the lay out of the pattern of geodesic lines are based upon a 40 mm spherical table tennis ball. Accordingly, the dimensions provided only apply to a 40 mm sphere. In order to utilize these directions for a non-40 mm ball, the following formula applies:

$$NewDimension = \frac{40\text{ mm Dimension} \times NewBallDiameter}{40\text{ mm}} \quad (1)$$

In equation 1, "40 mm Dimension" represents the dimensions described below and also specified in FIG. 1 as is also discussed below. "NewDimension" represents the dimension to substitute for the individual dimension described below used in the calculation. "NewBallDiameter" represents the diameter of the non 40 mm sphere that these directions are being used for.

The layout method described below involves physically measuring and marking the surface of the ball. It should be understood that these instructions provide but one example of how to lay out a pattern of geodesic lines corresponding to A3, B3 and H3. A3, B3 and H3 are known geometric spherical patterns that could be plotted in several ways known to those skilled in the art. As an example, the same patterns could be laid out utilizing a computer with appropriate software. In yet another example, the same approximate patterns could be calculated for individual panel elements which are later assembled to form a ball. Thus, it is not necessary to physically mark the ball in order to base a design upon the disclosed layout pattern described below.

In several embodiments, geodesic lines are physically marked on the ball utilizing a masking device that exactly matches the diameter of the ball in combination with a marking device such as a pencil or marker. This enables the drawing of smooth geodesics and the lining up of distance markers (DM's) placed on the geodesics. In these embodiments, a protractor may also be used to ensure accurate angles.

In a first embodiment, designs with tetrahedral symmetry (A3) are created by first drawing and labeling one geodesic (G1), and then another (G2) at a 90 degree ($\pi/2$) angle with the first geodesic (G1). The two intersections of G1 and G2 are then labeled as poles P1 and P2. DM's are then made by placing the tip (non-marking end) of a compass at P1, and marking G1 and G2, each at two points, at a Euclidean radius of 18.388 mm. These four points are DM's 1, 2, 3 and 4. This is then repeated at P2 to create DM's 5, 6, 7 and 8. DM's at P1 are then labeled 1, 2, 3, and 4 by choosing DM 1 to be on G1 and proceeding along the small circle clockwise to 2, 3, and 4. DM 1 and DM 3 are now labeled on G1 and DM 2 and DM 4 labeled on G2. DM's are then labeled at P2 by moving from DM 1 away from pole 1, along G1, to the next DM. This is then labeled DM 5. Looking down at P2 with DM 5 in the 12 o'clock position, one then proceeds clockwise along the small circle and labels DM 6, DM 7, and DM 8 successively. G3 is created by placing the ball in the masking device such that DM's 1, 2, 7, and 6 all lay on the geodesic to be marked, and then marking the circumference of the ball with the masking device and marking G3 with a marking device. Similarly, G4 is created by lining up DM's 3, 4, 5, and 8 in the masking device and marking G4 with a marking device. G5 is created by lining up DM's 2, 3, 5, and 6 in the masking device and marking G5 with a marking device. Finally, G6 is created by lining up DM's 1, 4, 7, and 8 in the masking device and marking G6 with a marking device.

In a second embodiment, designs with cubic and octahedral (B3) symmetry can be created by first marking the A3 pattern as described above, and then creating three more geodesics in the following way. Poles P3, P4, P5, and P6 are labeled as follows. The intersection of G3 and G4 closest to DM's 1, 4, 6, and 5 is labeled P3. The intersection of G3 and G4 closest to DM's 2, 3, 7, and 8 is labeled P4. The intersection of G5 and G6 closest to DM's 1, 2, 8, and 5 is labeled P5. The intersection of G5 and G6 closest to DM's 3, 4, 6, and 7 is labeled P6. G7 is created by lining up P's 4, 5, 3, and 6 in the masking device and marking G7 with a marking device. G8 is created by lining up P's 1, 5, 2, and 6 in the masking device and marking G8 with a marking device. G9 is created by lining up P's 2, 3, 1, and 4 in the masking device and marking G9 with a marking device.

In a third embodiment, designs with dodeca/icosahedral (H3) symmetry are created by first drawing and labeling one geodesic (G1), and then another (G2) at a 90 degree ($\pi/2$) angle with the first geodesic (G1). The intersections of G1 and G2 are then labeled P1 and P2. G3 is then drawn as an equator between P1 and P2, making four more 90 degree ($\pi/2$) angles. Holding the ball with P1 at the top, P2 at the bottom, and an intersection of G2 and G3 facing forward, this forward G2G3 intersection is labeled P3. Proceeding along G# to the right, the next intersection (G1G3) is labeled P4. Continuing in the same direction along G3, the next intersection (G2G3) is labeled P5. Continuing in the same direction along G3, the next intersection (G1G3) is labeled P6. At P1 with G1 horizontal and P6 to the left, a compass is used to mark and label DM1 on G1 7.257 mm to the left of P1, and DM2 on G1 7.257 mm to the right of P1. At P1 with G2 horizontal and P5 to the left, a compass is used to mark and label DM3 on G2 10.931 mm to the left of P1, and DM4 on G2 10.931 mm to the right of P1.

Continuing to discuss the third embodiment, at P2 with G1 horizontal and P6 to the left, a compass is used to mark and label DM5 on G1 7.257 mm to the left of P2, and DM6 on G1 7.257 mm to the right of P2. At P2 with G2 horizontal and P5 to the left, a compass is used to mark and label DM7 on G2 10.931 mm to the left of P2, and DM8 on G2 10.931 mm to the right of P2. At P3 with G2 horizontal and P1 to the left, a compass is used to mark and label DM9 on G2 7.257 mm to the left of P3, and DM10 on G2 7.257 mm to the right of P3. At P3 with G3 horizontal and P4 to the left, a compass is used to mark and label DM11 on G3 10.931 mm to the left of P3, and DM12 on G3 10.931 mm to the right of P3. At P4 with G3 horizontal and P3 to the left, a compass is used to mark and label DM13 on G3 7.257 mm to the left of P4, and DM14 on G3 7.257 mm to the right of P4. At P4 with G1 horizontal and P2 to the left, a compass is used to mark and label DM15 on G1 10.931 mm to the left of P4, and DM16 on G1 10.931 mm to the right of P4. At P5 with G2 horizontal and P1 to the left, a compass is used to mark and label DM17 on G2 7.257 mm to the left of P5, and DM18 on G2 7.257 mm to the right of P5. At P5 with G3 horizontal and P4 to the left, a compass is used to mark and label DM19 on G3 10.931 mm to the left of P5, and DM20 on G3 10.931 mm to the right of P5. At P6 with G3 horizontal and P5 to the left, a compass is used to mark and label DM21 on G3 7.257 mm to the left of P6, and DM22 on G3 7.257 mm to the right of P6. At P6 with G1 horizontal and P2 to the left, a compass is used to mark and label DM23 on G1 10.931 mm to the left of P6, and DM24 on G1 10.931 mm to the right of P6.

Continuing to discuss the third embodiment, G4 is created by placing the ball in the masking device such that DM's 1, 3, 19, 6, 8, and 12 are all aligned and marking G4 with a marking device. G5 is created by placing the ball in the masking device such that DM's 1, 20, 7, 6, 11, and 4 are all aligned and marking G5 with a marking device. G6 is created by placing the ball in the masking device such that DM's 2, 4, 12, 5, 7, and 19 are all aligned and marking G6 with a marking device. G7 is created by placing the ball in the masking device such that DM's 20, 3, 2, 11, 8, and 5 are all aligned and marking G7 with a marking device. G8 is created by placing the ball in the masking device such that DM's 14, 15, 8, 22, 24, and 3 are all aligned and marking G8 with a marking device. G9 is created by placing the ball in the masking device such that DM's 16, 14, 7, 23, 22, and 4 are all aligned and marking G9 with a marking device. G10 is created by placing the ball in the masking device such that DM's 15, 13, 4, 24, 21, and 7 are all aligned and marking G10 with a marking device. G11 is created by placing the ball in the masking device such that DM's 13, 16, 3, 21, 23, and 8 are all aligned and marking G11 with a marking device. G12 is created by placing the ball in the masking device such that DM's 11, 10, 23, 20, 17, and 16 are all aligned and marking G12 with a marking device. G13 is created by placing the ball in the masking device such that DM's 10, 12, 24, 17, 19, and 15 are all aligned and marking G13 with a marking device. G14 is created by placing the ball in the masking device such that DM's 12, 9, 16, 19, 18, and 23 are all aligned and marking G14 with a marking device. G15 is created by placing the ball in the masking device such that DM's 9, 11, 15, 18, 20, and 24 are all aligned and marking G15 with a marking device.

In any of the first, second or third embodiments discussed above, the specific orientation of G1 and G2 with respect to the other preexisting features of the ball should not be significant. However, in some embodiments, it may be advantageous to align G1 and/or G2 with a preexisting marking to provide a more pleasing final appearance. For example, if a baseball is marked, it may be advantageous to align G1 and G2 as tangential with a preexisting seam.

In any of the first, second or third embodiments, further modification of the marked A3, B3 or H3 patterns may be made. For example, in some embodiments, the pattern of geodesic lines may be marked utilizing a non-permanent marking device such as a pencil. This permits some portions of various geodesics to be removed if necessary to create a particular design. In other embodiments, the pattern of geodesic lines may be marked utilizing a permanent marking such as permanent ink. In still further embodiments, a portion of the triangles formed by the geodesics can be colored or filled in to add further contrast to the ball. Specific examples of such other embodiments are discussed below regarding FIGS. 5-14.

Further regarding the layout patterns A3, B3 and H3, there are several characteristics exhibited by these patterns that are different than other known patterns used to layout out ball designs. As an initial matter, the triangles created by the geodesics in these patterns are all right triangles that are identical in shape and size. However, the individual vertices created by these same geodesics are not all identical or uniform. Furthermore, these layout patterns exhibit symmetry across each geodesic.

Referring now to FIG. 1 triangular element 5 is illustrated. Triangular element 5 is a two-dimensional triangular representation of the spherical triangles created by the intersection of the various geodesics in the A3, B3, and H3 patterns are illustrated. Included in FIG. 1 are internal angles A, B and C, legs x and y, hypotenuse z and vertices 1, 2 and 3. It should be noted that as triangular element 5 is a non-planer triangle, angles A, B and C add up to more than 180 degrees, which is different than the result that would be obtained with a two-dimensional, non-spherical triangle.

Still referring to FIG. 1, in the following paragraphs, specific dimensions are provided for internal angles A, B and C, legs x and y and hypotenuse z. Please note that for each leg and the hypotenuse, two dimensions are specified for each pattern. The first dimension given is the Euclidean distance which is the distance of a straight line through a sphere between two points on the surface of the sphere. This distance does not take into account the spherical curvature of each of these "straight" lines as placed on a sphere. Accordingly, this dimension correlates to the dimension used with a compass for example to lay out each pattern. Conversely, the second dimension specified is the spherical distance. The spherical distance does take into account the spherical curvature of each of the "straight" lines placed on a sphere. Accordingly, the spherical distance mentioned could be utilized to create individual panel segments used to form a paneled spherical ball. In each case as previously discussed the dimensions given are for a 40 mm sphere. These dimensions can be scaled up or down using equation 1 as detailed above to determine appropriate dimensions for a ball of any diameter.

Specifically referring to FIG. 1 and the A3 pattern, angle A is equal to $\Pi/3$, angle B is also equal to $\Pi/3$ and angle C is a right triangle equal to $\Pi/2$. The Euclidean distance for leg x is 18.388 mm and the spherical dimension is 19.106 mm, for leg y the Euclidean dimension is 18.388 mm and the spherical dimension is 19.106 mm. For hypotenuse z the Euclidean distance is 23.094 mm and the spherical distance is 24.619 mm. Regarding the vertices, it is worth noting there are four vertices corresponding to vertex 1 on the A3 pattern on a full sphere. Similarly, there are four vertices corresponding to vertex 2 and six vertices corresponding to vertex 3 on A3 spherical design. Finally, there are a total of 24 triangular elements 5 on an A3 paneled sphere.

Specifically referring to FIG. 1 and the B3 pattern, angle A is equal to Π/4, angle B is also equal to Π/3 and angle C is a right triangle equal to Π/2. The Euclidean distance for leg x is 15.307 mm, the spherical dimension is 15.708 mm, for leg y the Euclidean dimension is 12.116 mm, the spherical dimension is 12.309 mm. For hypotenuse z the Euclidean distance is 18.388 mm, the spherical distance is 19.106 mm. Regarding the vertices, it is worth noting there are six vertices corresponding to vertex 1 on the B3 pattern on a full sphere. Similarly, there are eight vertices corresponding to vertex 2 and twelve vertices corresponding to vertex 3 on A3 spherical design. Finally, there are a total of 48 triangular elements 5 on a B3 paneled sphere.

Specifically referring to FIG. 1 and the C3 pattern, angle A is equal to Π/5, angle B is equal to Π/3 and angle C is a right triangle equal to Π/2. The Euclidean distance for leg x is 10.931 mm, the spherical dimension is 11.072 mm, for leg y the Euclidean dimension is 7.257 mm, the spherical dimension is 7.297 mm. For hypotenuse z the Euclidean distance is 12.817 mm, the spherical distance is 13.047 mm. Regarding the vertices, it is worth noting there are twelve vertices corresponding to vertex 1 on the B3 pattern on a full sphere. There are twenty vertices corresponding to vertex 2 and thirty vertices corresponding to vertex 3 on A3 spherical design. Finally, there are a total of 120 triangular elements 5 on an H3 paneled sphere.

For reference purposes, the respective dimensions for legs x and y and hypotenuse z related to triangular element 5 for the A3, B3 and H3 patterns are summarized in Table 1 below.

TABLE 1

| | x | | y | | z | |
|---|---|---|---|---|---|---|
| Pattern | Euclidean | Spherical | Euclidean | Spherical | Euclidean | Spherical |
| A3 | 18.388 mm | 19.106 mm | 18.388 mm | 19.106 mm | 23.094 mm | 24.619 mm |
| B3 | 15.307 mm | 15.708 mm | 12.116 mm | 12.309 mm | 18.388 mm | 19.106 mm |
| H3 | 10.931 mm | 11.072 mm | 7.257 mm | 7.297 mm | 12.817 mm | 13.047 mm |

Figure 2:
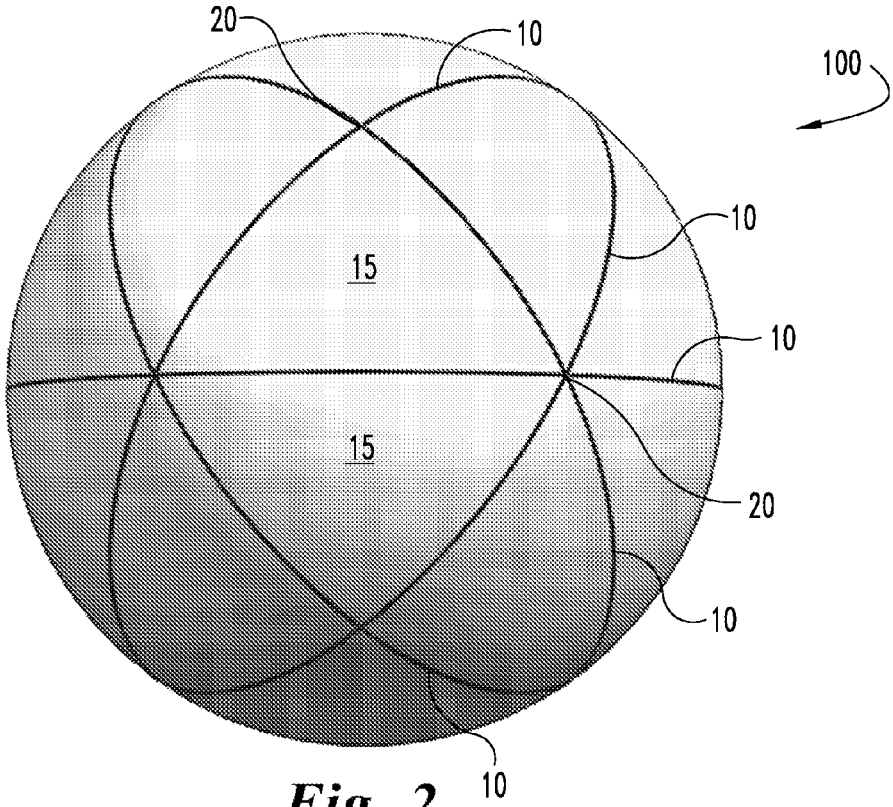
FIG. 2 is a diagrammatic representation of a ball or sphere including the A3 pattern embodiment of the Coxeter Complex pattern according to the methodology of the present disclosure.
Figure 3:
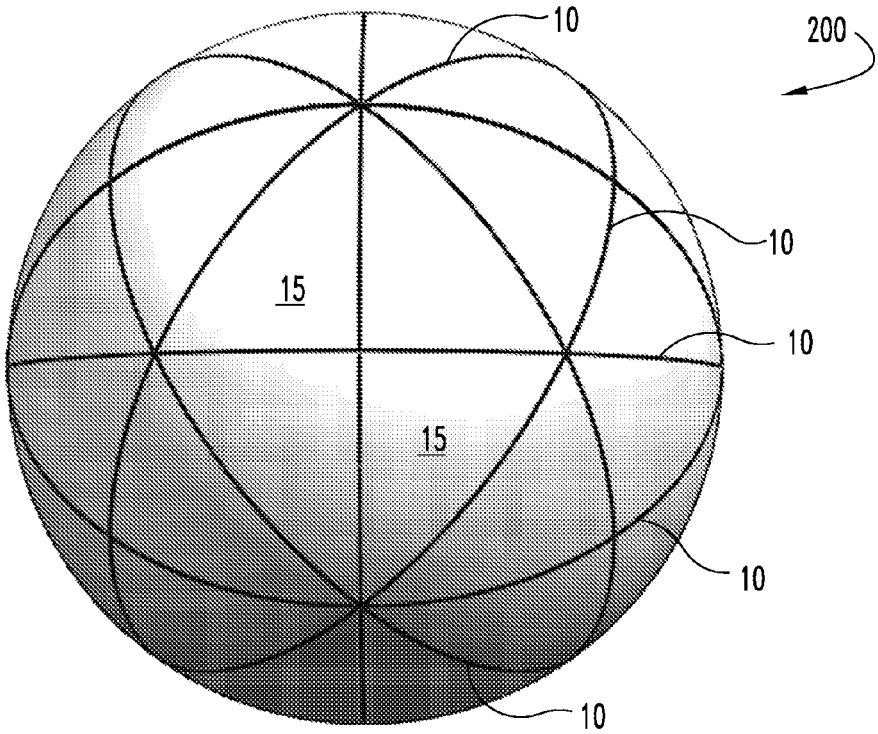
FIG. 3 is a diagrammatic representation of a ball or sphere including the B3 pattern embodiment of the Coxeter Complex pattern according to the methodology of the present disclosure.
Figure 4:
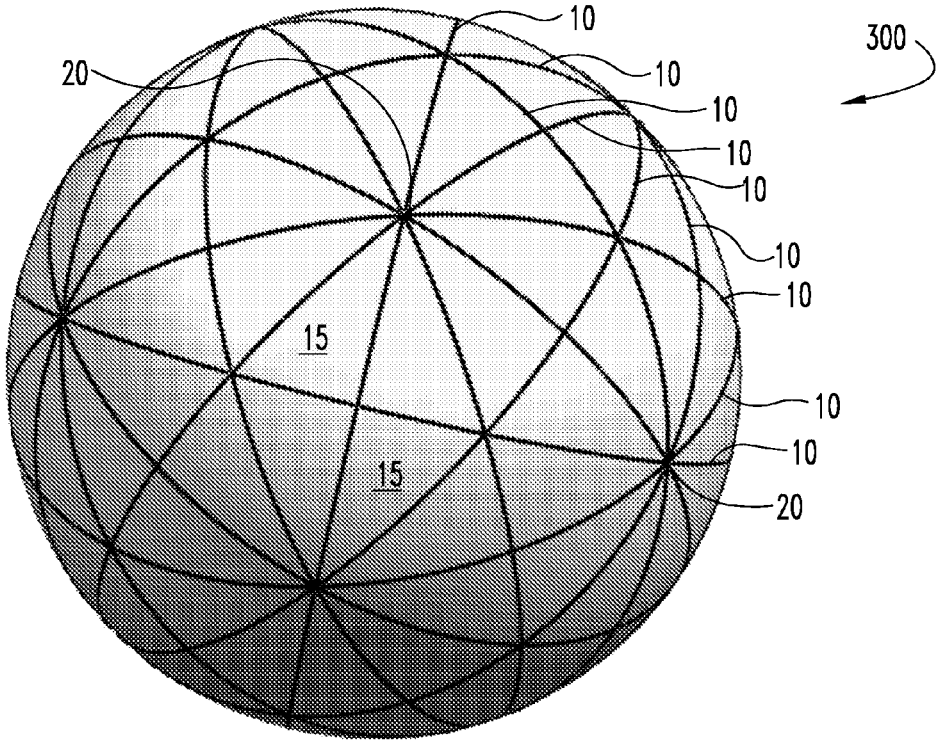
FIG. 4 is a diagrammatic representation of a ball or sphere including the H3 pattern embodiment of the Coxeter Complex pattern according to the methodology of the present disclosure.

Turning now to FIGS. 2-4, representations of the A3, B3 and H3 patterns are illustrated. Specifically, FIG. 2 illustrates the A3 pattern 100, FIG. 3 illustrates the B3 pattern 200 and FIG. 4 illustrates the H3 pattern 300. Each of FIGS. 2-4 includes a number of geodesics 10 as well as a number of vertices 20, the vertices 20 being the locations in which two or more geodesics 10 intersect. Geodesics 10 form a plurality of triangles 15 that cover the surface of the sphere. It should be noted that for each pattern or embodiment discussed in the following figures, a representative number of features have been labeled with reference numerals. However, to maintain clarity, not all duplicative features have been labeled with reference numerals. Each of FIGS. 2-4 has been shaded to illustrate the three dimensional round shape of a sphere. FIGS. 2-4 illustrate only a single hemisphere of the overall respective pattern. However, as these are symmetrical patterns, the other hemisphere that is not visible is an exact mirror image of the hemisphere that is visible. Furthermore, a comparison of FIG. 2 and FIG. 3 illustrates that the A3 pattern is fully contained within the B3 pattern.

While FIGS. 2-4 illustrate basic representations of the A3, B3 and H3 patterns disclosed herein, this disclosure is not so limited. For example, additional and/or different contrast patterns can be created by shading individual geodesics and/or individual design elements, such as triangles formed by the A3, B3 or H3 patterns, with various contrasting colors. Similarly, shapes of various shapes and sizes can be placed either along the geodesics or at some vertices. Alternatively, portions of individual geodesics can be removed or omitted. In yet other embodiments, the thickness and/or color of the geodesics can be varied. In any such embodiment, one goal of selecting a particular pattern and/or color is to create the best contrast pattern for a given application. Variables such as lighting conditions, recording technique, size of the ball, what sport is involved, the anticipated rotation speed of the ball being marked, the expected distance at which it is desired for the spin induced contrast marking to be observable and the ability level of the athletes utilizing an individual contrast pattern all affect what encompasses an optimum pattern and/or color.

FIGS. 5-14 are non-limiting examples of different contrast patterns based upon the A3, B3 or H3 patterns. Individual advantages and disadvantages for each of these different embodiments are discussed below. In each of FIGS. 5-14, the individual geodesics are illustrated in a black color, representing a contrasting color from the white base color of the ball. In these particular embodiments, the individual geodesics have been included to illustrate the relationship of the various patterns to the base A3, B3 and H3 patterns. However, it should be understood that alternate embodiments are envisioned wherein the individual geodesics are not colored a contrasting color.

Figure 5:
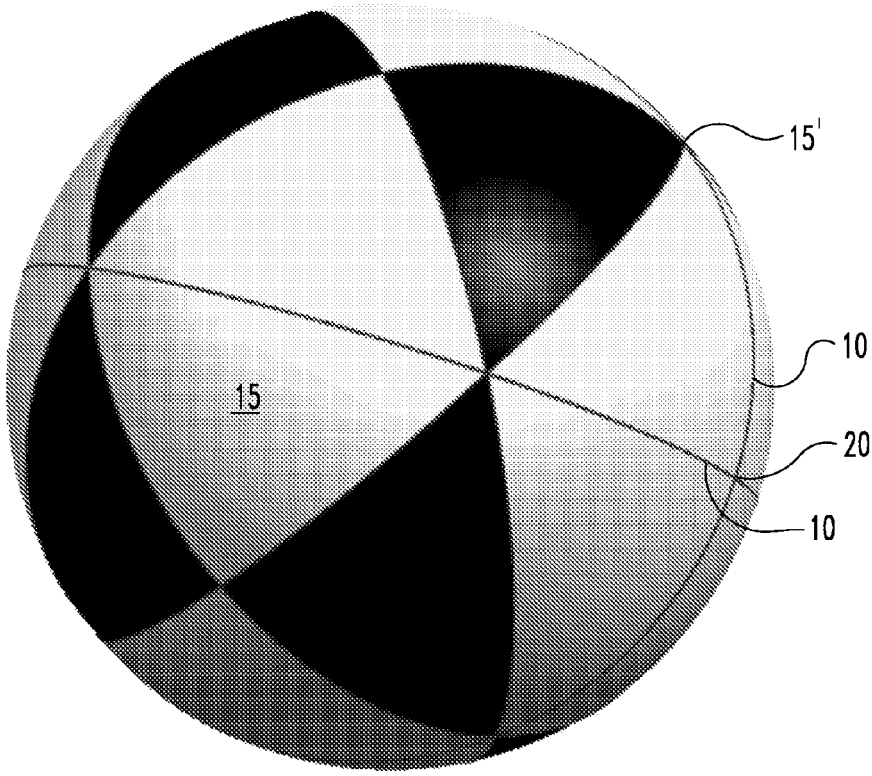
FIG. 5 is a diagrammatic representation of a ball or sphere including one embodiment of the A3 pattern of FIG. 2.

The contrast pattern embodiment illustrated in FIG. 5 is based on A3 pattern 100. This pattern provides relatively large contrasting triangles 15' where the contrasting triangles 15' fully incorporate four of the six geodesics used to construct the A3 pattern. One third of the surface area of this pattern is covered with contrasting triangles. This combination has been found to provide good overall contrast in general due to the relatively large shape of the individual contrasting portions. However, this pattern is not very symmetrical so when a ball having this pattern is spun, the resultant contrast lines that are created may appear to wobble to some observers.

Figure 6:
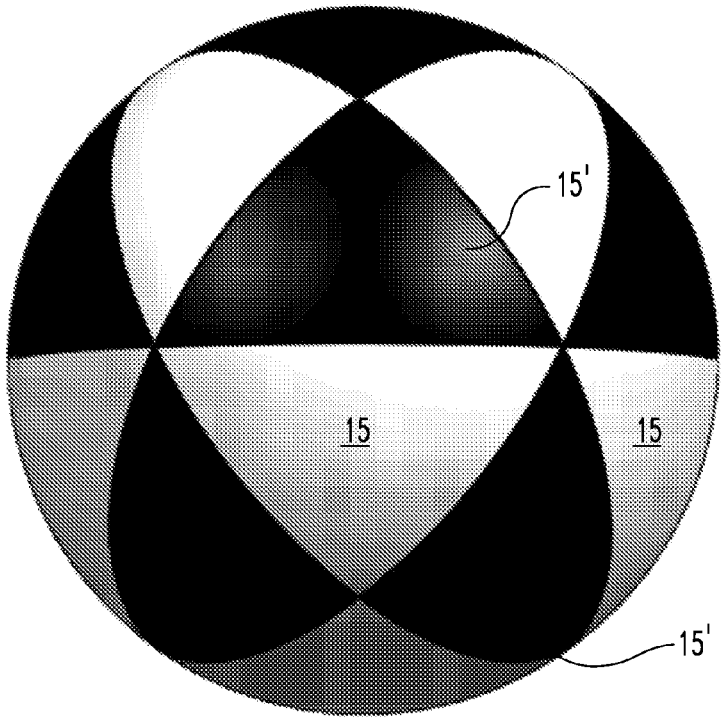
FIG. 6 is a diagrammatic representation of a ball or sphere including one embodiment of the A3 pattern of FIG. 2.

The contrast pattern embodiment illustrated in FIG. 6 is also based on A3 pattern 100. This pattern provides relatively large contrasting triangles 15' where the contrasting triangles 15' fully incorporate each of the six geodesics used to construct the A3 pattern. One half of the surface area of this pattern is covered with contrasting triangles 15'. This pattern has been found to provide good contrast in low spin speed situations due to the large shape of the individual triangles as well as the large percentage of contrasting portions. However, at high spin speeds, this pattern may appear excessively dark or grey for some observers or lighting conditions.

Figure 7:
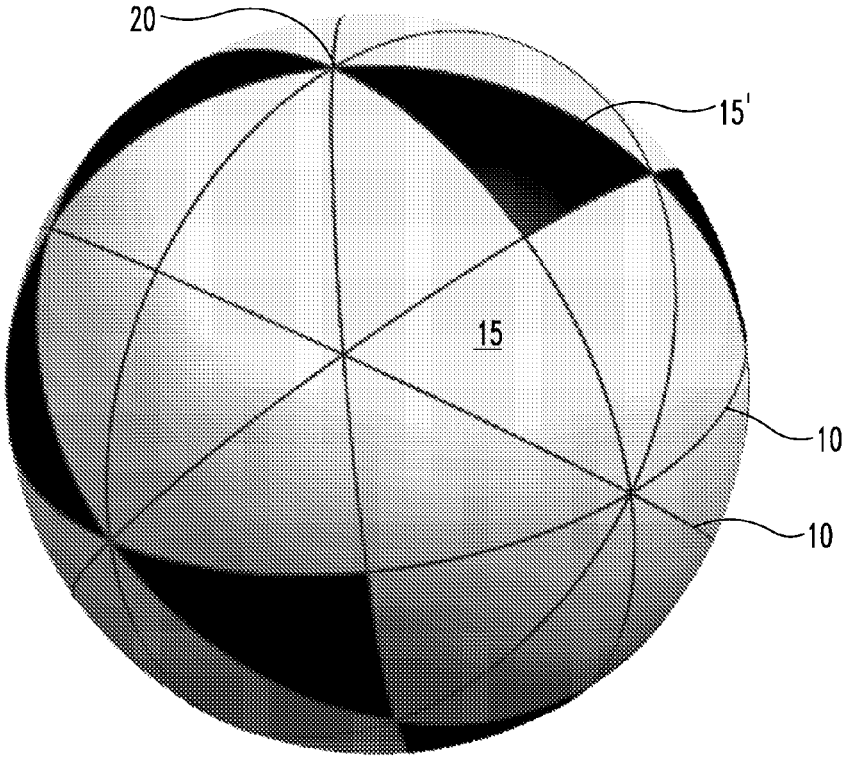
FIG. 7 is a diagrammatic representation of a ball or sphere including one embodiment of the B3 pattern of FIG. 3.

The contrast pattern embodiment illustrated in FIG. 7 is based on B3 pattern 200. This pattern provides intermediate sized contrasting triangles 15'. The primary feature of this design is that each contrasting triangle 15' is connected at two vertices 20 with other contrasting triangles 15'. The overall pattern seeks to mimic the seam pattern found on a standard baseball/tennis ball. Only 17% of the surface area of this pattern is covered with contrasting triangles 15'. This pattern has been found to provide a good combination of gross contrast providing improved visibility at low spin speeds as well as adequate contrast at high spin speeds yet still appears to be mostly white or the base color of the ball.

Figure 8:
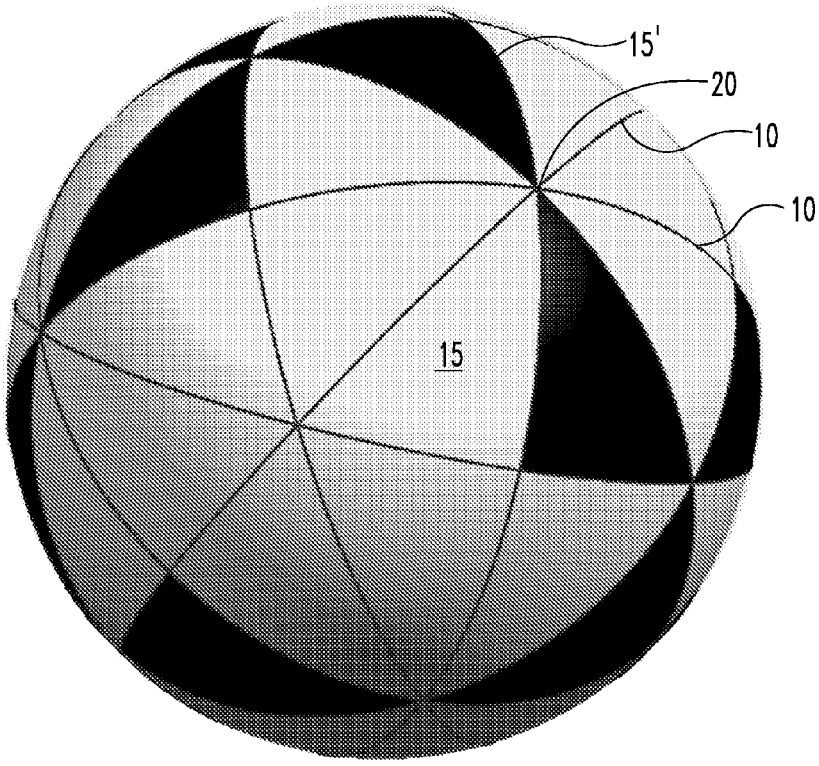
FIG. 8 is a diagrammatic representation of a ball or sphere including one embodiment of the B3 pattern of FIG. 3.

The contrast pattern embodiment illustrated in FIG. 8 is also based on B3 pattern 200. This pattern again provides intermediate sized contrasting triangles 15'. The primary feature of this design is that every contrasting triangle 15' is connected to at least two other contrasting triangles 15' at two vertices 20 and at least half of each of the geodesics are incorporated in contrasting triangles 15'. This feature provides good contrast at high spin speeds as well as good contrast at low spin speeds. This pattern covers 25% of the surface area of the ball with contrasting triangles.

Figure 9:
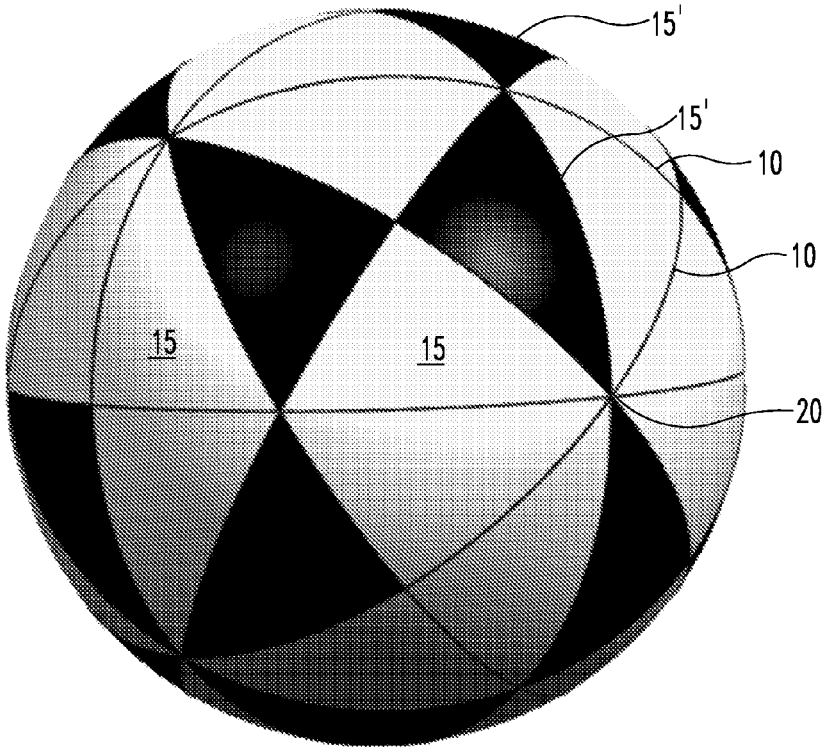
FIG. 9 is a diagrammatic representation of a ball or sphere including one embodiment of the B3 pattern of FIG. 3.

The contrast pattern embodiment illustrated in FIG. 9 is also based on B3 pattern 200. This pattern provides intermediate sized contrasting triangles 15'. The primary feature of this design is that the contrasting triangles 15' completely incorporate three of the nine geodesics 10 in the pattern and all of the contrasting triangles 15' are interconnected. This pattern covers one third of the surface area of the ball with contrasting triangles 15'. A further feature is that all the "white" or non-contrasting portions formed of adjacent triangles 15 found in this embodiment are identical in shape incorporating four adjacent (sharing common geodesics) triangles 15 of the pattern, making this embodiment particularly appropriate for use in a paneled ball.

Figure 10:
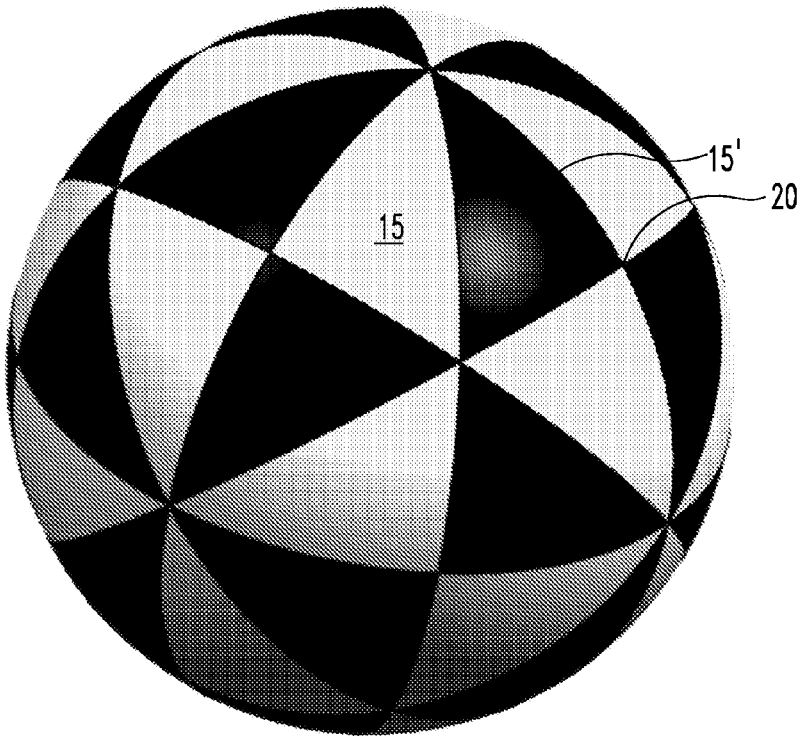
FIG. 10 is a diagrammatic representation of a ball or sphere including one embodiment of the B3 pattern of FIG. 3.

The contrast pattern embodiment illustrated in FIG. 10 is also based on B3 pattern 200. This pattern provides intermediate sized contrasting triangles 15'. The primary feature of this design is that the contrasting triangles 15' completely incorporate all of the nine geodesics 10 in the pattern and all of the contrasting triangles 15' are alternated with non-contrasting of "white" triangles 15. This pattern covers half of the surface area of the ball with contrasting triangles 15'. This pattern has been found to provide good contrast in low spin speed situations. However, similarly to the embodiment illustrated in FIG. 6, at high spin speeds, this pattern may appear too dark or grey for some observers or lighting conditions.

Figure 11:
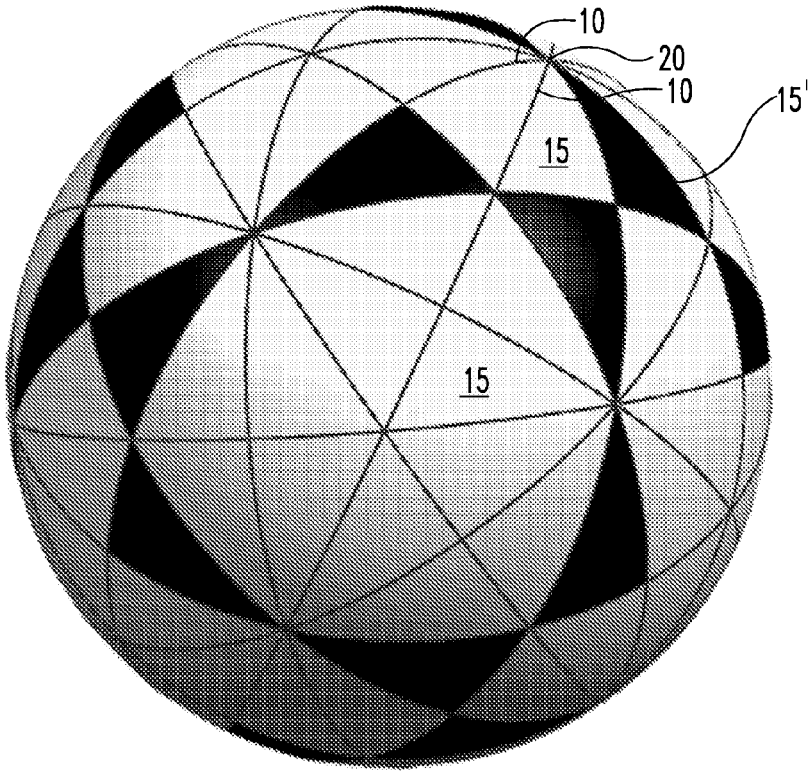
FIG. 11 is a diagrammatic representation of a ball or sphere including one embodiment of the H3 pattern of FIG. 4.

The contrast pattern embodiment illustrated in FIG. 11 is based on H3 pattern 300. This pattern provides small sized contrasting triangles 15'. The primary feature of this design is that the contrasting triangles 15' completely incorporate three of the fifteen geodesics 10 in the pattern and all of the contrasting triangles 15' are interconnected. This pattern covers one fifth of the surface area of the ball with contrasting triangles 15' and has good symmetry. This embodiment provides good contrast at both high and low spin speeds yet still appears to be mostly white or the base color of the ball.

Figure 12:
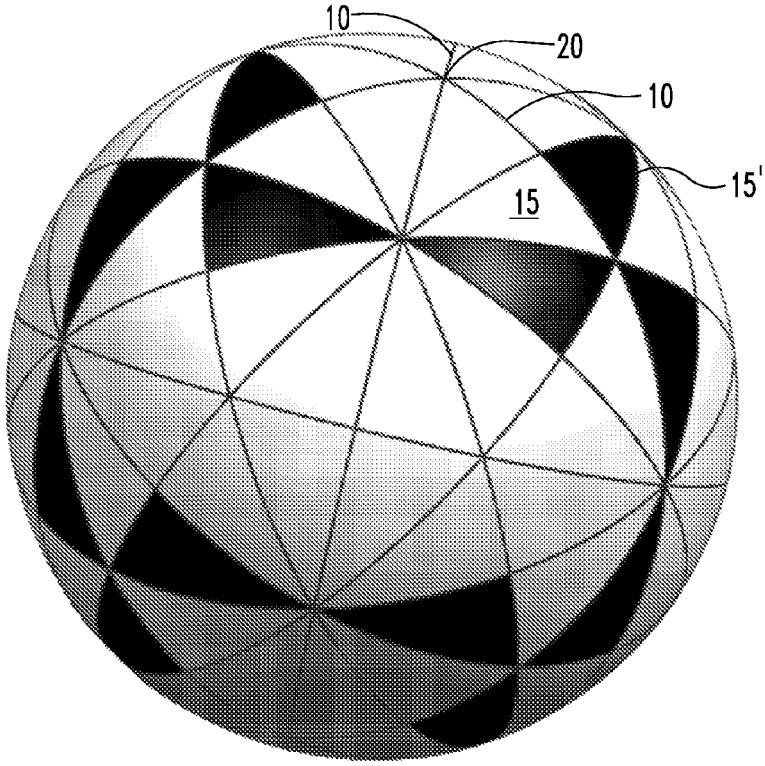
FIG. 12 is a diagrammatic representation of a ball or sphere including one embodiment of the H3 pattern of FIG. 4.

The contrast pattern embodiment illustrated in FIG. 12 is also based on H3 pattern 300. This pattern provides small sized contrasting triangles 15'. The primary feature of this design is that the contrasting triangles 15' substantially incorporate all of the fifteen geodesics 10 in the pattern and all of the contrasting triangles 15' are interconnected. This pattern covers one fifth of the surface area of the ball with contrasting triangles 15' and has good symmetry. This embodiment provides good contrast at both high and low spin speeds yet does not excessively "grey out" at high spin speeds. See FIG. 17*b* and accompanying description below for a specific example.

Figure 13:
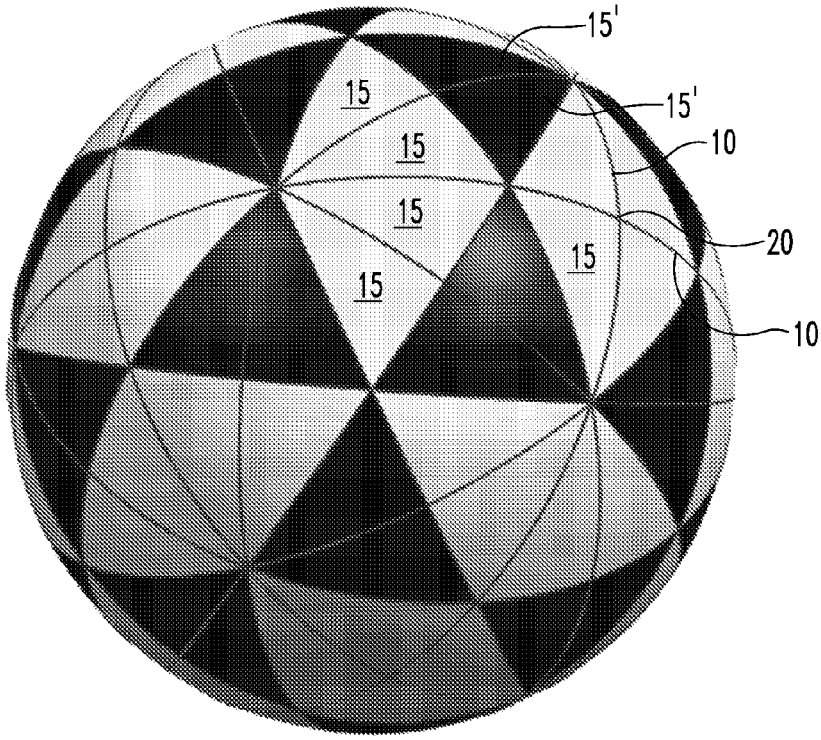
FIG. 13 is a diagrammatic representation of a ball or sphere including one embodiment of the H3 pattern of FIG. 4.

The contrast pattern embodiment illustrated in FIG. 13 is also based on H3 pattern 300. This pattern provides small sized contrasting triangles 15' that are always paired (sharing common geodesic 10), resulting in intermediate sized contrast portions. The primary feature of this design is that the contrasting triangles 15' incorporate a significant percentage of each of the fifteen geodesics 10 in the pattern and all of the contrasting triangles 15' are interconnected. This pattern covers two fifths of the surface area of the ball with contrasting triangles and has excellent symmetry. This embodiment provides similar contrast to that found in the embodiment illustrated in FIG. 10, but this embodiment has better high spin speed contrast in most applications and typically does not appear as grey.

Figure 14:
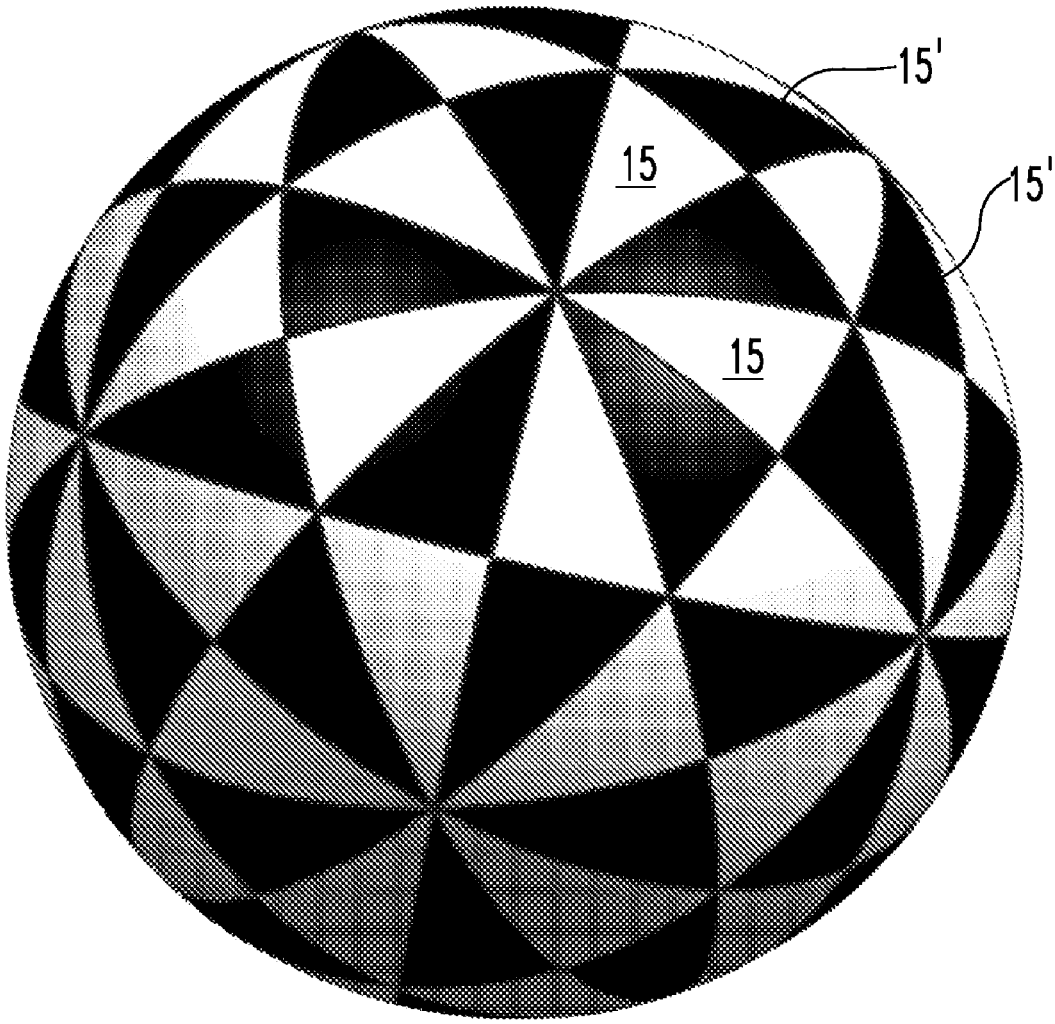
FIG. 14 is a diagrammatic representation of a ball or sphere including one embodiment of the H3 pattern of FIG. 4.

The contrast pattern embodiment illustrated in FIG. 14 is also based on H3 pattern 300. This pattern provides small sized contrasting triangles 15'. The primary feature of this design is that the contrasting triangles 15' completely incorporate all of the fifteen geodesics 10 in the pattern and all of the contrasting triangles 15' are alternated with non-contrasting of "white" triangles 15 (sharing common geodesics 10). This pattern covers half of the surface area of the ball with contrasting triangles 15'. This pattern has been found to provide good contrast in low spin speed situations due to the large number of contrasting triangles 15' as well as the large contrasting portion percentage. However, similarly to the embodiments illustrated in FIGS. 6 and 10, at high spin speeds, this pattern may appear too dark or grey for some observers or lighting conditions. See discussion below for FIG. 18*b* for a specific example.

Regarding the thickness of the geodesics illustrated in FIGS. 2-14, in each example the illustrated thickness is approximately 0.75% of the overall diameter of the illustrated sphere. This choice of line thickness should not be viewed as exemplary, as this thickness is a simple byproduct of the drafting technique utilized to generate FIGS. 2-14. In many applications this line thickness may be too thin to be adequately visible. However, in other applications, this line thickness may be preferable or even too thick. It is envisioned that the line thickness could vary between 0.25% of the overall diameter of the ball up to 15% of the overall diameter of the ball. As an example, for a 40 mm diameter table tennis ball with an H3 line pattern, a line thickness of approximately 1 mm, or 2.5% of the overall diameter generates adequate spin induced contrast for many players under typical indoor lighting conditions.

Turning now to FIGS. 15-18, specific non-limiting examples are provided which show the appearance of several different embodiments when spun. Specifically referring to FIGS. 15*a*, 15*b* and 15*c*, an embodiment of A3 pattern 100 is shown. FIG. 15*a* is a picture of table tennis ball 40 that has been marked with geodesic lines 10 corresponding to A3 pattern 100. In this embodiment, the geodesic thickness is approximately 4% of the overall diameter of the table tennis ball. FIGS. 15*b* and 15*c* show table tennis ball 40 rotating at high speed on two different axis's of rotation. In FIG. 15*b*, contrast lines 50 appear to waver to some degree and grey space 55 is apparent between contrast lines 50. In FIG. 15*c*, contrast lines 50 appear to approximate straight lines and grey space 55 is more uniform. The apparent differences in the appearance of the spin induced contrast lines 50 between FIGS. 15*b* and 15*c* is due to differences in the alignment of the axis of spin with respect to the geodesic lines on the table tennis ball. In FIG. 15*c*, it is apparent that the axis of rotation is approximately perpendicular to one geodesic 10 because one contrast line 50 appears in the middle of ball 40 while in FIG. 15*b* it is apparent that the axis or rotation of ball 40 is not exactly perpendicular to any single geodesic 10 because the contrast lines 50 appear offset from the middle of ball 40 and the grey space 55 is less uniform and darker. However, even though no geodesic 10 is exactly perpendicular to the axis of rotation of ball 40, several contrast lines are observable.

Figure 16A:
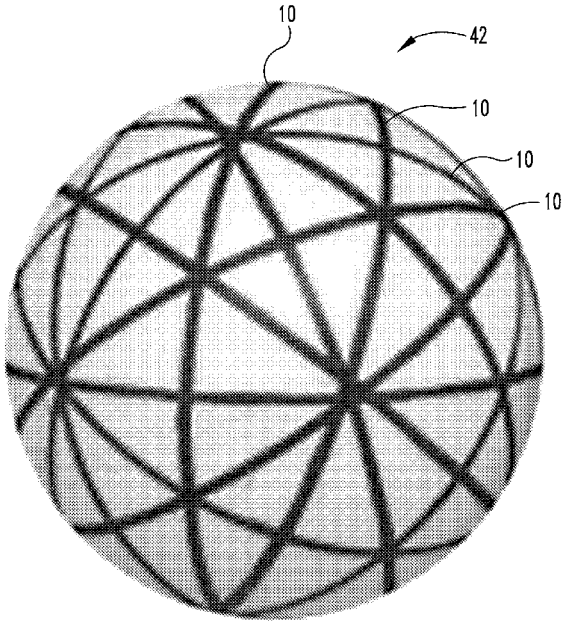
FIG. 16*a* is a photograph of a table tennis ball including an embodiment of the H3 pattern of FIG. 4.
Figure 16B:
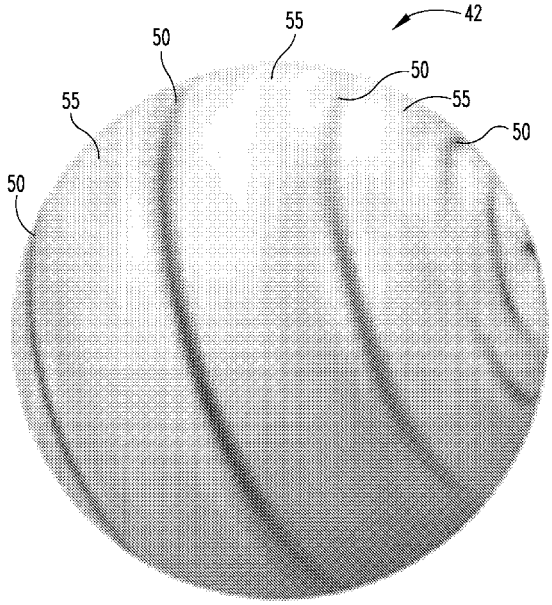
FIG. 16*b* is a photograph of the table tennis ball of FIG. 16*a* rotating about an axis of rotation.

FIGS. 16*a* and 16*b* illustrate an embodiment of H3 pattern 300. FIG. 16*a* is a picture of table tennis ball 42 that has been marked with geodesic lines 10 corresponding to H3 pattern 300. In this embodiment, the geodesic thickness is approximately 2.5% of the overall diameter of the table tennis ball. FIGS. 16*b* show table tennis ball 42 rotating at high speed. In FIG. 16*b*, contrast lines 50 appear to approximate straight lines and grey space 55 is relatively uniform. Comparing FIGS. 15*c* and 16*b*, it is apparent that the embodiment corresponding to the H3 pattern, shown in FIG. 16*b*, generates a larger number of contrast lines when spun than the embodiment corresponding to the A3 pattern, shown in FIG. 15*c*. As a result, the wavering contrast lines apparent in FIG. 15*b* are not as apparent when the axis of rotation is varied in the embodiment illustrated in FIGS. 16*a* and 16*b*. This improvement is related to the increase in the number of geodesics on the ball. Having fifteen geodesics instead of 6 decreases the degree with which an axis of rotation could be non-perpendicular to one of the geodesics.

Figure 17A:
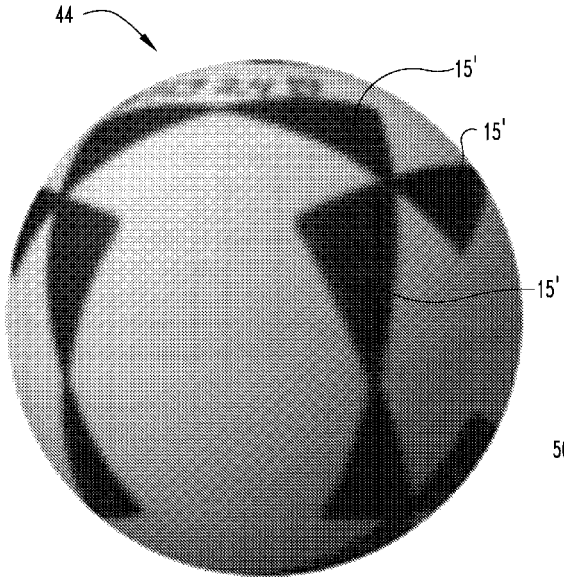
FIG. 17*a* is a photograph of a table tennis ball including an embodiment of the H3 pattern of FIG. 12.
Figure 17B:
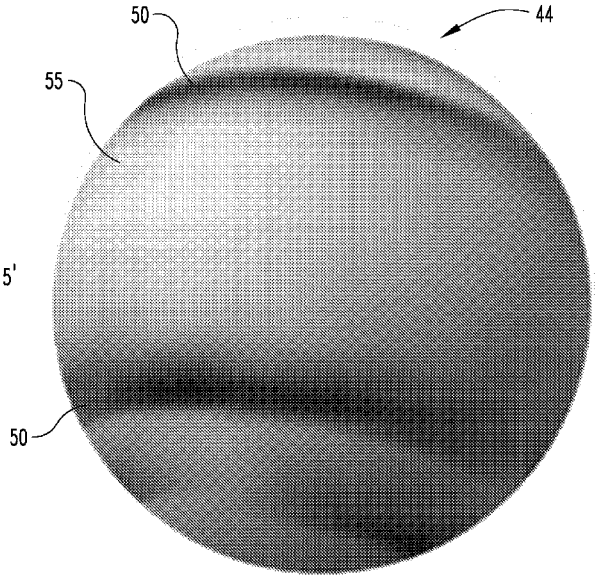
FIG. 17*b* is a photograph of the table tennis ball of FIG. 17*a* rotating about an axis of rotation.

FIGS. 17*a* and 17*b* show an embodiment similar to that illustrated in FIG. 12. FIG. 17*a* is a picture of a table tennis ball 44 that has a pattern of contrasting triangles 15' applied on the basis of H3 pattern 300. However, the geodesic lines 10 have been omitted from ball 44. This could be accomplished by removal of the geodesic lines after contrasting triangles 15' have been marked, or this could be accomplished through a computer aided layout and marking, for example. In any event, FIG. 17*b* is a picture of table tennis ball 44 rotating at high speed. Contrast lines 50 appear to approximate straight lines and grey space 55 is relatively uniform.

Figure 18A:
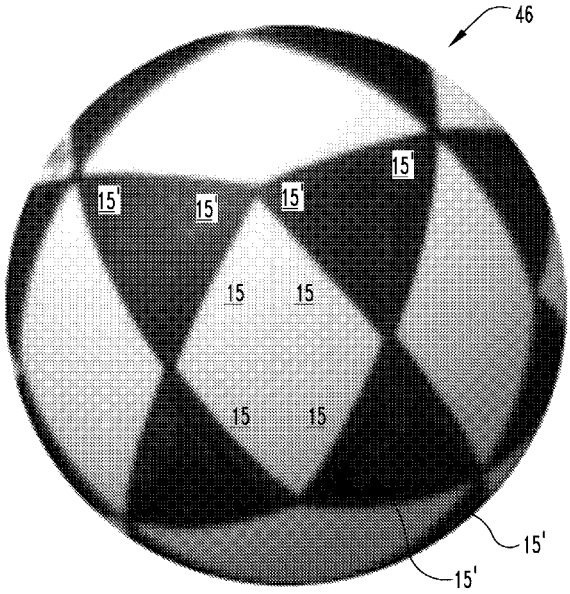
FIG. 18*a* is a photograph of a table tennis ball including an embodiment of the H3 pattern of FIG. 14.
Figure 18B:
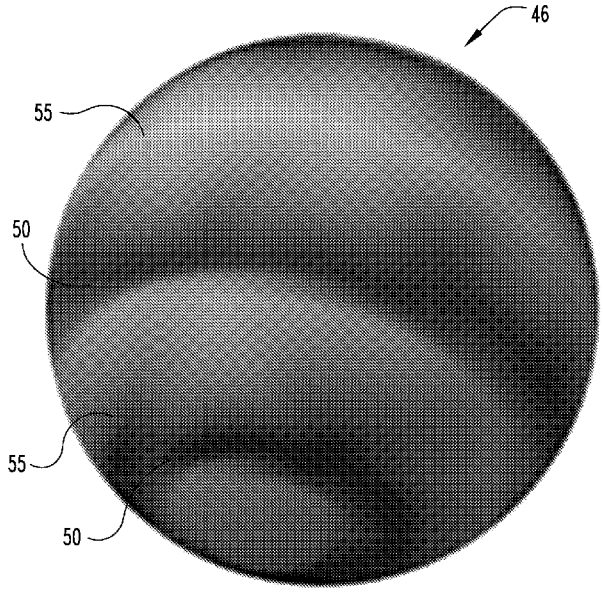
FIG. 18*b* is a photograph of the table tennis ball of FIG. 18*a* rotating about an axis of rotation.

FIGS. 18*a* and 18*b* show an embodiment similar to that illustrated in FIG. 13. Once again, in this illustrated embodiment, geodesic lines 10 have been omitted from ball 46. FIG. 18*a* is a picture of table tennis ball 46 with a pattern of contrasting triangles 15' applied on the basis of the H3 pattern. FIG. 18*b* is a picture of table tennis ball 46 rotating at high speed. Contrast lines 50 appear uneven. Similarly, grey space 55 is uneven and appears to change shade in proportion to the distance from contrast lines 50.

Figure 19:
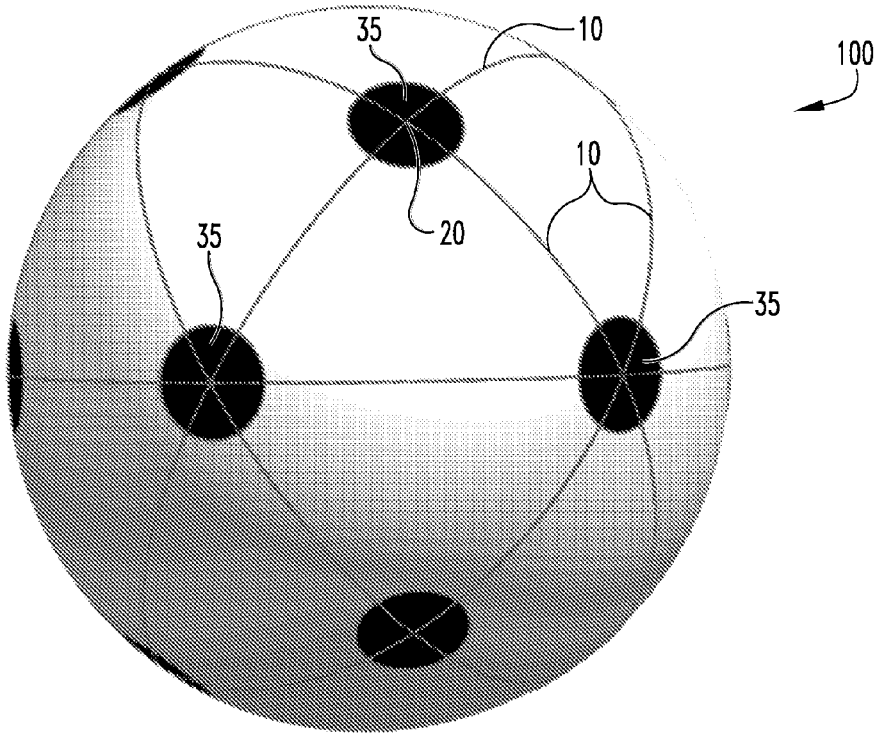
FIG. 19 is a diagrammatic representation of a ball or sphere including an alternate embodiment based on the A3 pattern of FIG. 2.

As yet another non-limiting embodiment of the application of markings that exhibit spin induced contrast, FIG. 19 illustrates several dots 35 which have been located on the basis of A3 pattern 100. Geodesic lines 10 corresponding to the A3 pattern are illustrated for reference purposes only, the inclusion of geodesic line 10 are optional. The centers of dots 35 are located at several symmetrically located geodesic 10 vertices 20. In this particular embodiment, each vertex 20 includes a dot 35. However, other embodiments are envisioned that do not include a dot 35 at each vertices 20. It is also envisioned that other geodesic patterns could include dots 35. In this embodiment, the dots 35 have a diameter approximately equal to 16% of the diameter of the ball. Although dots 35 are illustrated in this embodiment, other embodiments combining other contrast markings with dots 35 are also envisioned.

Figure 20:
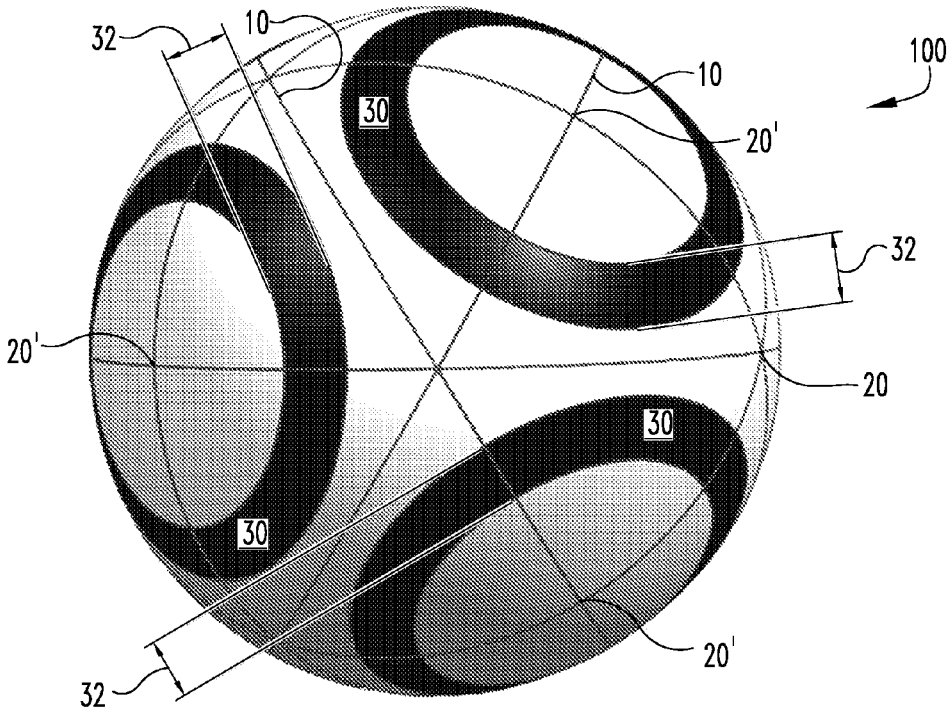
FIG. 20 is a diagrammatic representation of a ball or sphere including an alternate embodiment based on the A3 pattern of FIG. 2.

FIG. 20 illustrates an alternate embodiment similar to the embodiment illustrated in FIG. 19. FIG. 20 illustrates several circular lines 30 having a diameter and a line width 32 where the center of each circular line 30 is located at a vertex of geodesic lines. In the illustrated embodiment, the geodesics are based on the A3 pattern 100, and the vertices 20' used as the center of the circular lines 30 correspond to the center of a radial projection on a sphere of a cubic face.

Still referring to the embodiment illustrated in FIG. 20, the diameters of various circular lines 30 have been selected so that each of the circular lines 30 do not touch other circular lines 30 and the gap between different circular lines 30 is approximately equal to line width 32 at the closest point. In this embodiment, Geodesic lines 10 are illustrated mainly for reference; the inclusions of contrasting geodesic lines 10 are an optional part of the markings. For reference, the line width 32 of the circular lines illustrated in FIG. 20 is approximately 9% of the diameter of the ball.

Figure 21:
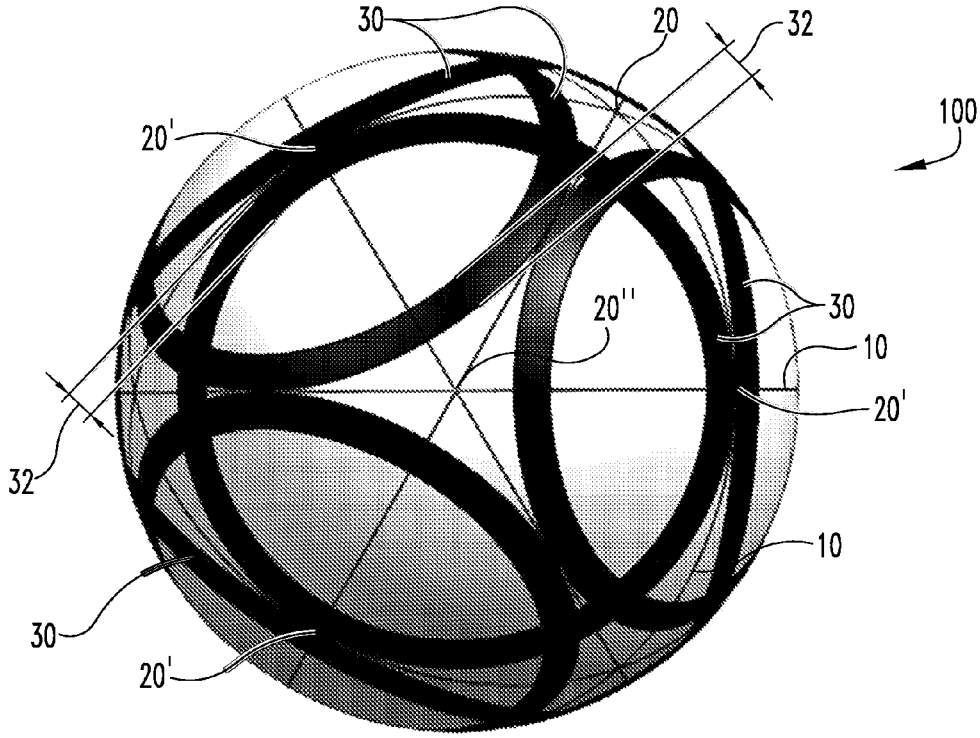
FIG. 21 is a diagrammatic representation of a ball or sphere including an alternate embodiment based on the A3 pattern of FIG. 2.

FIG. 21 illustrates an alternate embodiment similar to the embodiment illustrated in FIG. 20. FIG. 21 illustrates several circular lines 30 having a diameter and a line width 32 where the center of each circular line 30 is located at a vertex of geodesic lines. In the illustrated embodiment, the geodesics are based on the A3 pattern 100, and the vertices 20' used as the center of the circular lines 30 correspond to the center of a face of a radial projection of a cube on a sphere while the vertices 20" used as the center of circular lines 30 correspond to the center of a face of a radial projection of a tetrahedron on a sphere.

Still referring to the embodiment illustrated in FIG. 21, the diameters of various circular lines 30 have been selected so that each of the circular lines 30 substantially overlaps other circular lines 30. In particular, the diameter of each of the circular lines 30 have been selected so that each of the circular lines 30 is substantially tangential to the various neighboring geodesics 10 which surround vertices 20' and 20". In this embodiment, the circular lines corresponding to the center of a face of a radial projection of a cube on a sphere have a different diameter than the circular lines corresponding to the center of a face of a radial projection of a tetrahedron on a sphere. Geodesic lines 10 are illustrated mainly for reference; the inclusion of contrasting geodesic lines 10 are an optional part of the contrast markings. For reference, the line width 32 of the circular lines illustrated in FIG. 21 is approximately 5% of the diameter of the ball.

Figure 22:
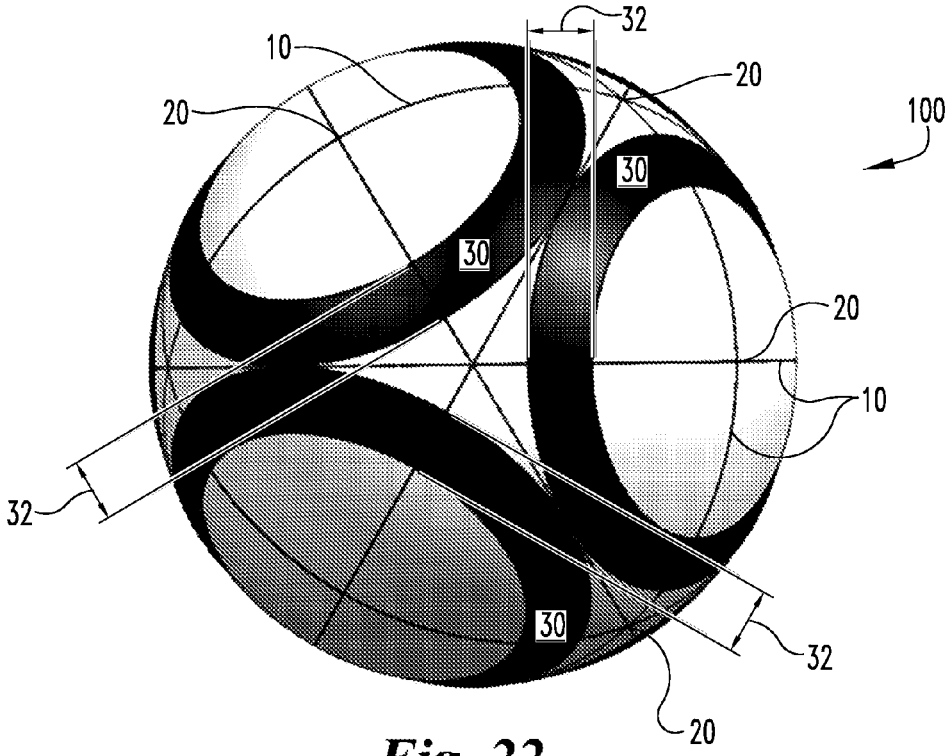
FIG. 22 is a diagrammatic representation of a ball or sphere including an alternate embodiment based on the A3 pattern of FIG. 2.

FIG. 22 illustrates an alternate embodiment similar to the embodiment illustrated in FIG. 20. FIG. 22 illustrates several circular lines 30 having a diameter and a line width 32 where the center of each circular line 30 is located at a vertex of geodesic lines. In the illustrated embodiment, the geodesics are based on the A3 pattern 100, and the vertices 20' used as the center of the circular lines 30 correspond to the center of a face of a radial projection of a cube on a sphere.

Still referring to the embodiment illustrated in FIG. 22, the diameter of each of the circular lines 30 have been selected so that each of the circular lines 30 touches, but does not overlap other circular lines 30. In this way, several points on circular line 30 are tangential to various geodesics 10. In this embodiment, geodesic lines 10 are illustrated mainly for reference; the inclusions of contrasting geodesic lines 10 are an optional part of the markings. For reference, the line width 32 of the circular lines illustrated in FIG. 22 is approximately 10% of the diameter of the ball.

While FIGS. 19-22 illustrate several different embodiments of contrast markings in the form of dots 35 or circular lines 30, the illustrated embodiments do not disclose every possible use of these features. For example, it is envisioned that it may be beneficial to have circular lines of larger or smaller diameters than the examples that have been provided. In addition, it is envisioned to use other patterns of geodesic lines such as B3 pattern 200 or H3 pattern 300 as the basis of the location of the center of these features. Similarly, it is possible to use the center of faces of other the radial projections on a sphere of other Platonic solids such as octahedrons, icosahedrons or dodecahedrons or other combinations of patterns to achieve attractive and useful contrast patterns. It is also envisioned that these different patterns can be mixed and matched as appropriate for a particular application or appearance that may be found desirable.

As yet another non-limiting embodiment of the application of markings that exhibit spin induced contrast, FIGS. 23-26 illustrates different triangular patterns that have been found to be both attractive and which produce good contrast lines when spun. Specifically, FIGS. 23-26 illustrate different variations of triangular shaped contrast markings as follows.

Figure 23:
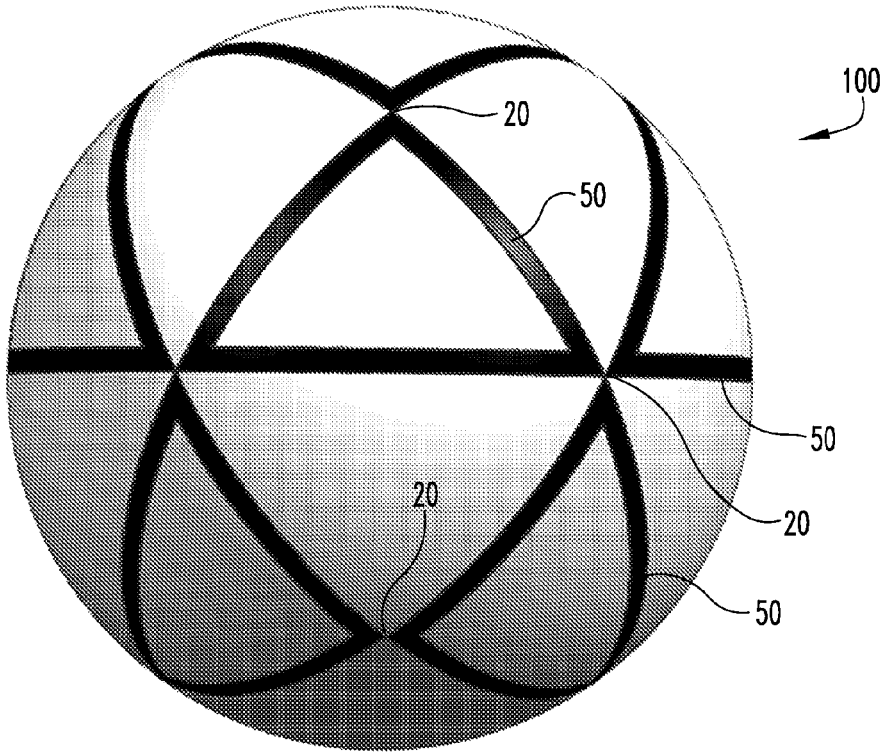
FIG. 23 is a diagrammatic representation of a ball or sphere including an alternate embodiment based on the A3 pattern of FIG. 2.

The contrast pattern embodiment illustrated in FIG. 23 is based on A3 pattern 100 and is related to the embodiment illustrated in FIG. 6. FIG. 23 illustrates a plurality of triangular designs 50 located on the basis of A3 pattern 100. Triangular design 50 comprises a hollow triangle whose edges are defined by three different geodesics 10. This same effect can be achieved by taking the design illustrated in FIG. 6 and adding white or base colored triangles inside of contrasting triangles 15'. The result is a hollow triangle that has a line thickness. In the illustrated embodiment, the line thickness is approximately 3% of the diameter of the ball.

Figure 24:
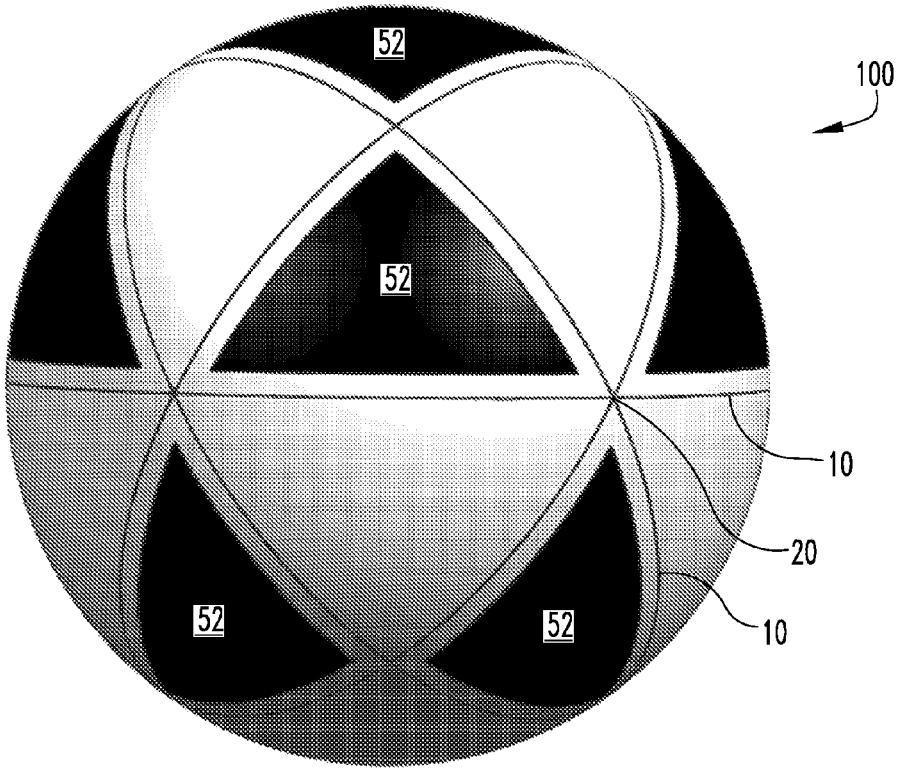
FIG. 24 is a diagrammatic representation of a ball or sphere including an alternate embodiment based on the A3 pattern of FIG. 2.

The contrast pattern illustrated in FIG. 24 is also based on A3 pattern 100 and is also related to the embodiment illustrated in FIGS. 6 and 23. FIG. 24 illustrates a plurality of triangular designs 52 located on the basis of A3 pattern 100. Also illustrated are geodesic lines 10 corresponding to A3 pattern 100. In this embodiment, triangular designs 52 are smaller than the corresponding triangles 15 defined by geodesics 10, so that there is a gap between triangular designs 52 and geodesics 10. In this embodiment, triangular designs 52 are approximately centered within triangles 15 so that the various gaps between triangular designs 52 and geodesics 10 are approximately equal. The embodiment illustrated in FIG. 24 is related to the embodiment illustrated in FIG. 23 because the triangular elements 50 and 52 are, in effect, black/white reversed images of each other. Furthermore, while triangular design 54 has been illustrated in the center of triangle 15, it should be understood that triangular design could be located in any desired position, including offset from the center or touching one or more geodesics.

Figure 25:
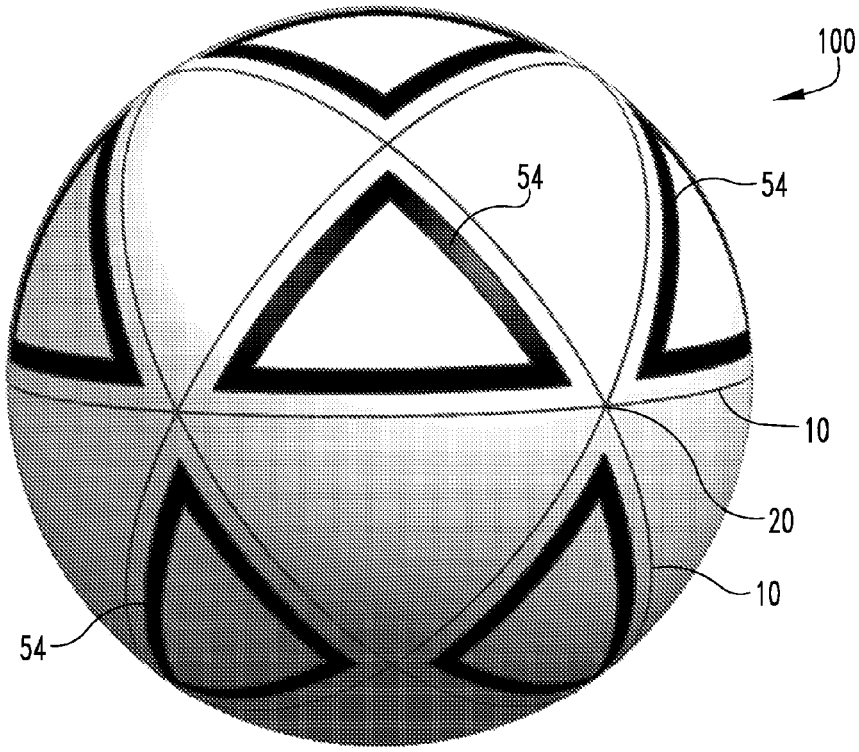
FIG. 25 is a diagrammatic representation of a ball or sphere including an alternate embodiment based on the A3 pattern of FIG. 2.

The contrast pattern illustrated in FIG. 25 is also based on A3 pattern 100 and is also related to the embodiment illustrated in FIGS. 6 and 24. FIG. 25 illustrates a plurality of triangular designs 54 located on the basis of A3 pattern 100. Also illustrated are geodesic lines 10 corresponding to A3 pattern 100. In this embodiment, triangular designs 54 are smaller than the corresponding triangles 15 defined by geodesics 10, so that there is a gap between triangular designs 54 and geodesics 10. Furthermore, triangular designs 54 have a hollow interior similar to the triangular designs 50 illustrated in FIG. 23. In the embodiment illustrated in FIG. 25, triangular designs 54 are approximately centered within triangles 15 so that the various gaps between triangular designs 54 and geodesics 10 are approximately equal. Another feature of this embodiment is the gaps between the triangular designs 54 and geodesics 10 are approximately equal to the line width of the triangular designs 54. Furthermore, while triangular design 54 has been illustrated in the center of triangle 15, it should be understood that triangular design could be located in any desired position, including offset from the center or touching one or more geodesics.

Figure 26:
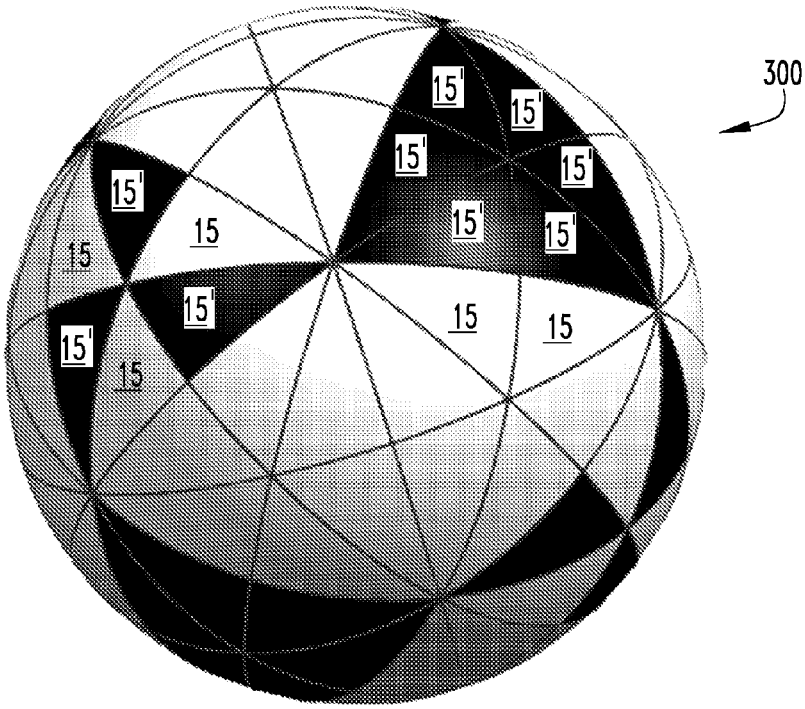
FIG. 26 is a diagrammatic representation of a ball or sphere including an alternate embodiment based on the H3 pattern of FIG. 4.

The contrast pattern illustrated in FIG. 26 is based on H3 pattern 300. This pattern provides both small sized contrasting triangles 15' and larger sized contrasting areas formed from multiple contrasting triangles 15'. The primary feature of this design is the combination of relatively small contrasting features with relatively large contrasting features. In this embodiment, each contrasting triangle 15' is interconnected with at least two other contrasting triangles 15'. Once again, the inclusion of geodesics 10 as contrasting lines is optional. Geodesics lines are illustrated primarily for reference in FIG. 26. This pattern covers thirty percent of the surface area of the ball with contrasting triangles 15'. This pattern has been found to provide good low spin speed contrast due to the significant variations in the appearance of the design. Another advantage of this embodiment is good contrast visualization at both near and far distances as well as for individuals with varying visual acuity.

Figure 27:
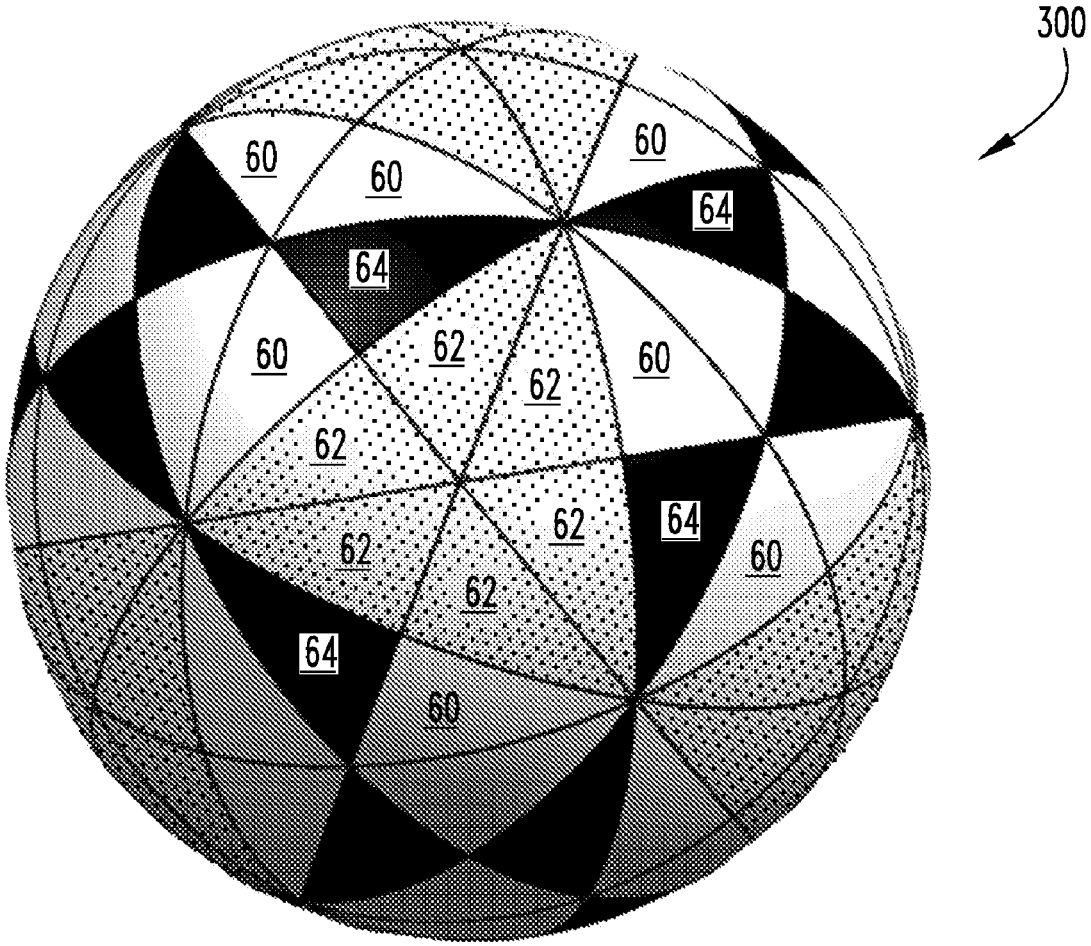
FIG. 27 is a diagrammatic representation of a ball or sphere including an alternate embodiment based on the H3 pattern of FIG. 4.

Another embodiment of a contrast pattern is illustrated in FIG. 27 which is based on H3 pattern 300. In this embodiment three different colors are utilized. In this specific example, white triangles 60, yellow triangles 62 and black triangles 64 are illustrated. The use of additional contrast colors may increase the overall viability of the ball or sphere as follows.

Light sources (or objects reflecting light) of different color transmit light of different wavelengths. The human visual system processes different colored stimulations at different speeds. For monochromatic stimuli, light at 555 nanometers (yellow green/optic yellow) produces a comparably fast response from the human visual system because of overlapping response of the retinal cone cell sensitivities in the human eye. White light, which contains light emissions of all visible wavelengths, including 555 nanometers, produces a response faster than any monochromatic light. It has been found that an exceptional combination is optic yellow with as much white included as possible. This may be due to the typical environmental background at sporting events. In particular, white is a commonly encountered color in many environments while optic yellow is not. Thus, while white light may be processed faster responses, optic yellow provides a more easily tracked color than white in may circumstances. In the present case, combining optic yellow panels with white panels give another contrast for the human visual system to follow that also corresponds to a comparably fast response from the human visual system. In addition, combining yellow with white allows the use of more vivid yellows in the contrasting portions than may be used in a monochromatic ball. When a ball having both optic yellow panels and white panels spins, the colors blur together to create the appearance of an even lighter shade of yellow, which can also be easily seen. Thus, the combination of optic yellow panels with white panels may produce a pattern with better overall visibility than a ball colored either white or yellow. The inclusion of black colored panels provides additional contrasts (white/black and yellow/black) and also produces contrast lines when the ball or sphere is rotated.

Referring again to the embodiment illustrated in FIG. 27, it is noted that there is a multitude of different variations on this individual theme that are contemplated. Once again, the overriding considerations are the lighting and play conditions in which a particular ball or sphere is to be used. It is also significant for the ball or sphere to be visually attractive. Other combinations of patterns and colors that exhibit spin induced contrast and improved visibility should be apparent to those skilled in the art on the basis of this disclosure.

Regarding choice of colors for use as the contrast pattern, the primary factor is selecting a color that adequately contrasts the base color(s) of the particular ball so as to be visible under likely lighting and playing conditions. In that respect, it is possible to utilize different colors for different elements of the contrast pattern. However, in general, it has been noted that using multiple colors may result in a blurring of the spin induced contrast lines as compared to using a single contrasting color. Alternatively, in some specific applications, use of multiple colors may provide more specific information to the viewer regarding the particular axis of rotation that is being observed, especially when there is a known reference point such as when the ball is oriented at a known starting position, for example, in a pitcher's grip before throwing the ball. In such an application, it may be advantageous to color particular geodesics and/or patterns that correspond to particular axis of rotations differently to provide specific feedback regarding the particular spin induced by a particular throwing motion and/or ball grip. (Not illustrated.)

Regarding the construction of the ball in which a pattern is applied, the ball may be constructed using any known method. For example, the ball may have an inner bladder covered with panels whose edges correspond to various geodesics. Alternatively, the ball may be formed of panels whose edges do not correspond to various geodesics. In that regard, these panels may be formed of leather, synthetic material or any material known to those skilled in the art for use in ball paneling. In other embodiments, the ball may have a solid inner portion or an inner portion formed of wound matter. In yet other embodiments, the ball may be molded to have a hollow interior with a molded surface. In any event, any known type of ball or method of manufacture is envisioned within the scope of this disclosure.

Specifically regarding the application of this disclosure to the construction of a ball using a paneling method, it is envisioned that the geodesic patterns A3, B3 and H3 may be used as the basis for a paneling pattern. In that way, the natural seam line that occurs when a ball is paneled would also serve the function of a contrast marking. Similarly, in the embodiments discussed above wherein some of the "triangles" defined by these geodesic patterns are colored differently, it would be possible to achieve the same effect by creating differently colored panels that are assembled to form a ball. In this regard, it is not necessary that each panel have the same geometry or that every panel corresponds to an individual "triangle." In several examples discussed above, multiple "triangles" are grouped together having the same color without any distinguishing geodesic line divider. Thus, it is envisioned that an individual panel component used to panel a ball could be composed of multiple individual "triangle" elements as defined in the A3, B3 and H3 geodesic patterns.

Along these lines, it is also envisioned that a ball could be paneled using a single panel corresponding to these geodesic patterns which contains multiple contrasting colors. In one embodiment, this could include an individual panel composed of multiple individual "triangle" elements as defined in the A3, B3 and H3 geodesic patterns wherein one or more "triangle" has a color which contrasts the rest of that individual panel. Similarly, in another embodiment, an individual panel composed of multiple individual "triangle" elements as defined in the A3, B3 and H3 geodesic patterns could incorporate some contrasting marking, such as a particular pattern or line segments of individual geodesics contained within the individual panel element.

It should be noted that not all balls used in sports are perfectly spherical or even necessarily approximately so. The geodesics discussed herein are, in a mathematical sense, based on the perfect symmetry of a perfect sphere. However, it may not be possible to achieve perfect symmetry with an irregular, approximately spherical ball. This disclosure is not so limited. The methods described herein are applicable to any approximately spherical ball. The only significant limitation envisioned is if the ball is so irregular that it cannot generate a stable spin, then it may be difficult to create observable spin induced contrast lines. When marking irregular balls, it has been observed that while the techniques described herein may not result in a perfect pattern, the resulting pattern does create observable spin induced contrast lines, so long as the pattern is applied as accurately as possible given the irregularities. As a specific example, table tennis ball 42 shown in FIG. 16*a* does not have perfectly applied geodesics. For example, the vertices 20 appear wider than an individual geodesic 10, indicating that geodesics 10 are not perfectly aligned. However, it is believed that this particular embodiment still exhibits acceptable spin induced contrast, as seen in FIG. 16*b*. Accordingly, wherein, traditionally, terms such as geodesic or symmetry as applied to a sphere may be limited to a perfect sphere, these terms are intended to apply herein to any object having approximately spherical shape.

Applying contrasting portions to a ball used in sports based upon the symmetric placement of a number of geodesics derived from the Coxeter Complex provides a high probability that one or more of the geodesics will be perpendicular, or nearly so, to the particular axis of spin of the ball. As a result, one or more lines that are perpendicular to the axis of spin will be apparent to a viewer of the spinning ball. In situations in which no individual geodesic is perpendicular to the axis of spin, segments of several separate geodesics may combine to create the appearance of one or more lines perpendicular to the axis of spin. A viewer of the ball, or in particular, a player, could use the appearance of the perpendicular lines to anticipate both the axis of spin and the magnitude of the spin of the ball on the basis of the particular appearance of the spinning ball. In particular, to anticipate the axis of spin or rotation, a viewer simply has to translate the apparent contrast line approximately 90 degrees. It is important to note that, in general, such a translation of axis would typically occur subconsciously, rather than be a process requiring conscious decision making.

This effect is due in part to ability, or relative lack thereof, of the human visual system to track rapidly moving objects, such as a discrete pattern on a rotating ball. In the example of a rotating ball, when an object/pattern moves (rotates) faster than the visual system's ability to accurately process its movement, a blurring effect is created where the visual system, in effect, coalesces the rapidly moving object/pattern with its surroundings to generate an integrated image to the human brain. In the case of an object/pattern on a ball having a contrasting base color, the color of the object/pattern and the ball is integrated by the visual system to form an integrated color somewhere between the color of the object/pattern and the ball. When the object/pattern is significantly aligned to be perpendicular to the axis of rotation, this coalescing/integrating effect generates a contrast line as discussed herein. This is also true of when multiple segments of different objects/patterns align along a plane perpendicular to the axis of rotation. The generated integrated image's shade/contrast is proportional to the percentage of the object/pattern as opposed to the base portion of the ball that is aligned along a particular plane. When a significant portion that is aligned along a particular plane is from the object/pattern, then a contrast line may be visible. For example, in FIGS. 16-18, it is apparent that contrast lines are generated from the aggregate contribution of multiple portions of different objects/patterns on the individual balls.

Such a ball may be useful as a training device for athletes of all abilities by both aiding the athlete in reading ball spin to improve anticipation of the spinning ball's future position as well as to aid the athlete in accurate visual tracking of the spinning ball in general by providing improved contrast of the ball. It is believed that such training has a transfer effect which improves the athlete's ability to both follow any ball more closely as well as training the athlete to anticipate the flight of any spinning ball. Thus, it is believed that by playing or practicing with balls that include markings that exhibit spin induced contrasts lines, an athlete can improve their subsequent performance with plain balls.

As known in the art, balls from various types of sports react in different ways to spin. For example, a spinning ball may generate aerodynamic forces that cause the ball to move in a trajectory that is different from a strictly ballistic trajectory. Similarly, when a spinning ball interacts with other objects such as a play surface, racket or bat, a spinning ball may generate an unexpected rebound direction. Such spinning effects are particularly significant in many of the aforementioned sports.

As way of a non-limiting example, baseball is a sport in which a spinning ball is particularly significant. Successfully pitching a ball to a hitter involves throwing the ball faster than the hitter's ability to react to the pitch as well as deceiving a hitter regarding the eventual location of the pitched ball when it "crosses the plate." Thus, it is very useful for a hitter to accurately anticipate the eventual location of a pitched ball so that the hitter can make contact with the ball using a bat. Thus, additional information provided to a hitter regarding the likely trajectory of a pitched ball may improve the hitter's ability to hit the ball.

In this regard, it is unlikely, although not unheard of, that bodies governing various sports leagues, especially professional leagues, would authorize the use of a ball having contrasting portions that exhibit spin induced contrast for use in game situations, as this may unbalance the sport or make the sport too easy. One example would be baseball, where such a change would likely favor of hitters over pitchers. However, in that regard, it is believed that a ball having contrasting portions would still be useful, even where such a ball could not be used in game situations. For example, hitters train extensively to improve their ability to hit pitched balls. One factor that makes hitting pitched baseballs difficult is the variable spin that is applied to individual pitches. For example, curve balls and sliders are spinning pitches thrown with the intention of substantial sideward movement of the ball to confuse the hitter regarding where the pitched ball will be when it reaches the hitter. It is believed that hitter will be able to improve his performance in hitting pitched balls by training with balls that have been marked with contrasting portions that exhibit spin induced contrast. It is believed that the hitter will improve his ability to follow pitched balls in general, even non-spinning ones, due to the presence of the contrasting portions. Furthermore, it is believed that the hitter will learn to recognize cues besides those provided by the added contrasting portions by training with a ball having the contrast portions. In addition, pitchers may benefit from practicing with balls that exhibit spin induced contrast by providing feedback to the pitcher regarding both the magnitude and axis of spin created by a particular pitch. This should aid the pitcher in training themselves to have repeatable accuracy with their pitches.

By way of further non-limiting examples, it is believed that similar improvements in athletic performance may be achieved in other sports such as tennis, squash, hand-ball, table tennis, volleyball, basketball, soccer or any other sport requiring participants to interact with a spinning ball. Giving the athlete additional information regarding the spin of a ball facilitates the athlete in better anticipating the ball's trajectory and the balls interaction with other objects such as a wall, floor or racket. Training with a ball having contrast portions as disclosed above it is thought to improve both the athletes' ability to follow the ball as well as to help train the athlete to better interpret other signs of ball rotation.

In one aspect of the disclosure, a ball with markings that exhibit spin induced contrast is disclosed comprising: a layout pattern that corresponds to the diameter of the ball, the layout pattern prepared from plurality of symmetrically arranged geodesics, wherein the number of geodesics is selected from the group consisting of 6, 9 and 15 and wherein the layout pattern has a plurality of vertices and a plurality of triangular elements; a ball color; and a plurality of markings located on the ball on the basis of the layout pattern, wherein the plurality of markings are colored a marking color which contrasts the ball color and the plurality of markings exhibit a spin induced contrast line when the ball is rotated about any axis of rotation In another aspect of the disclosure, a method of marking a ball with markings that exhibit a spin induced contrast line is disclosed comprising the steps of: a) selecting a Coxeter Complex pattern from the group consisting of A3, B3 and H3, which includes a plurality of geodesics and a plurality of geodesic vertices; b) plotting the selected Coxeter Complex pattern over the surface of the ball; c) selecting markings that will exhibit spin induced contrast; and d) applying to the surface of the ball the markings selected wherein the location of the markings is correlated with the selected Coxeter Complex pattern and wherein the markings contrasts the ball.

In yet another aspect of the disclosure, a method for detecting the axis of spin of a ball is disclosed comprising the steps of: providing a ball with a plurality of markings that exhibit a spin induced contrast line when the ball is rotated about any axis of rotation, wherein the plurality of markings are located on the ball on the basis of a Coxeter Complex pattern from the group consisting of A3, B3 and H3; spinning the ball about the axis of rotation; observing a contrast line apparent on the surface of the spinning ball generated by markings on the surface of the ball, wherein the contrast line is approximately perpendicular to the axis of rotation; and determining the axis of rotation of the ball by translating the apparent contrast line approximately 90 degrees.

While this disclosure has been illustrated and described in detail in the drawings and foregoing description, the same is to be considered as illustrative and not restrictive in character, it being understood that only a limited number of embodiments have been shown and described and that all changes and modifications that come within the spirit of the invention are desired to be protected.

What is claimed is:

1. A ball with markings that exhibit spin induced contrast comprising:

a layout pattern that corresponds to the diameter of the ball, the layout pattern prepared from plurality of symmetrically arranged geodesics, wherein the number of geodesics is selected from the group consisting of 6, 9 and 15 and wherein the layout pattern has a plurality of vertices and a plurality of triangular elements;

a ball color; and a plurality of markings located on the ball on the basis of the layout pattern, wherein the plurality of markings are colored a marking color which contrasts the ball color and the plurality of markings exhibit a spin induced contrast line when the ball is rotated about any axis of rotation and wherein the plurality of markings incorporate a majority of the geodesics.

2. The ball of claim 1, wherein the plurality of vertices are not all identical and the plurality of triangular elements are spherical right triangles.

3. The ball of claim 1, wherein the plurality of markings cover between 5% and 20% of the surface of the ball.

4. The ball of claim 1, wherein the plurality of markings include a plurality of lines having a line width.

5. The ball of claim 4, wherein the line width is less than 10% of the diameter of the ball.

6. The ball of claim 4, wherein the line width is between one third of one percent and three percent of the diameter of the ball.

7. The ball of claim 1, wherein the plurality of markings include a plurality of triangular markings that are located to correspond to some of the plurality of triangular elements.

8. The ball of claim 7, wherein the outer periphery of the plurality of triangular markings are scaled from the triangular elements.

9. The ball of claim 1, wherein the plurality of markings include a plurality of circular marking elements.

10. The ball of claim 9, wherein each of the plurality of circular marking elements contact other circular marking elements.

11. The ball of claim 9, wherein each of the plurality of circular marking elements substantially overlaps other circular marking elements.

12. The ball of claim 1, wherein the surface of the ball comprises a plurality of joined panels and the edges of individual panels correspond to at least two geodesics from the layout pattern.

13. The ball of claim 1, further including a visibility color, wherein the visibility color is different than the ball color and the marking color.

14. The ball of claim 1, wherein the number of geodesics is equal to 6.

15. The ball of claim 1, wherein the number of geodesics is equal to 9.

16. The ball of claim 1, wherein the number of geodesics is equal to 15.

17. The ball of claim 1, wherein the plurality of markings include a plurality of triangular markings that are located with edges parallel to the geodesics.

18. A method of marking a ball with markings that exhibit a spin induced contrast line comprising the steps of:

a) selecting a Coxeter Complex pattern from the group consisting of A3, B3 and H3, which includes a plurality of geodesics and a plurality of geodesic vertices;

b) plotting the selected Coxeter Complex pattern over the surface of the ball;

c) selecting markings that incorporate a majority of the geodesics and that will exhibit spin induced contrast; and d) applying to the surface of the ball the markings selected wherein the location of the markings is correlated with the selected Coxeter Complex pattern and wherein the markings contrasts the ball.

19. The method of claim 18, further comprising the steps of:

e) selecting a paneling pattern that is correlated with the selected Coxeter Complex pattern such that each panel includes two edges that could be correlated with separate geodesics; and f) paneling the ball using panels from the selected paneling pattern.

20. The method of claim 18, wherein the markings cover less than 50% of the surface area of the ball.

21. The method of claim 18, wherein the markings cover between 5% and 20% of the surface area of the ball.

22. The method of claim 18, wherein the selected marking are a plurality of lines having a line width.

23. The method of claim 22, wherein the selected line width is less than 10% of the diameter of the ball.

24. The method of claim 18, wherein the selected marking are a plurality of triangular markings that are located to have edges that are parallel to the geodesics.

25. The method of claim 24, wherein the outer periphery of the plurality of triangular markings are scaled from the triangular elements created by the plurality of geodesics.

26. The method of claim 18, wherein the selected marking include a plurality of circular markings wherein the center of the circular markings are approximately centered on the faces of a radial projection of a Platonic solid on a sphere.

27. The method of claim 18, wherein the Coxeter Complex pattern is A3.

28. The method of claim 18, wherein the Coxeter Complex pattern is B3.

29. The method of claim 18, wherein the Coxeter Complex pattern is H3.

30. A ball with markings that exhibit spin induced contrast comprising:

a ball color; and a plurality of triangular markings on the ball colored a marking color that contrasts the ball color, wherein the triangular markings are substantially uniformly scaled from triangular elements of a Coxeter Complex pattern corresponding to the diameter of the ball selected from the group consisting of A3, B3 and H3 and wherein the triangular markings are arranged on the ball to be substantially centered in the triangular elements of the selected Coxeter Complex pattern.

31. The ball of claim 30, further comprising a plurality of linear markings on the ball colored the marking color, wherein the linear markings substantially correspond to the geodesics forming the selected Coxeter Complex pattern.

32. The ball of claim 30, wherein the triangular markings are hollow triangles.

33. The ball of claim 30, wherein the selected Coxeter Complex pattern is A3.

34. The ball of claim 30, wherein the selected Coxeter Complex pattern is B3.

35. The ball of claim 30, wherein the selected Coxeter Complex pattern is H3.

* * * * *

UNITED STATES PATENT AND TRADEMARK OFFICE

CERTIFICATE OF CORRECTION

PATENT NO. : 7,444,770 B2
APPLICATION NO. : 11/539740
DATED : November 4, 2008
INVENTOR(S) : James L. Wellington, Jr.

It is certified that error appears in the above-identified patent and that said Letters Patent is hereby corrected as shown below:

Line 4, on Page 2 of the Patent under References cited, patent document 6,529,184 to Julienne, remove the "*" designation.

Signed and Sealed this

Thirtieth Day of December, 2008

JON W. DUDAS
*Director of the United States Patent and Trademark Office*